US010444671B2

(12) United States Patent
Shibukawa et al.

(10) Patent No.: US 10,444,671 B2
(45) Date of Patent: Oct. 15, 2019

(54) IMAGE FORMING APPARATUS HAVING A DEVELOPER DETECTING UNIT

(71) Applicant: CANON KABUSHIKI KAISHA, Tokyo (JP)

(72) Inventors: Kenta Shibukawa, Mishima (JP); Masahito Kato, Gotemba (JP); Atsushi Toda, Fuji (JP); Taku Watanabe, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/638,055

(22) Filed: Jun. 29, 2017

(65) Prior Publication Data

US 2018/0004124 A1 Jan. 4, 2018

(30) Foreign Application Priority Data

Jul. 4, 2016 (JP) ..... 2016-132602
Jul. 4, 2016 (JP) ..... 2016-132603
May 31, 2017 (JP) ..... 2017-107460

(51) Int. Cl.
*G03G 15/08* (2006.01)

(52) U.S. Cl.
CPC ..... *G03G 15/0889* (2013.01); *G03G 15/086* (2013.01); *G03G 15/0865* (2013.01); *G03G 2215/0805* (2013.01)

(58) Field of Classification Search
CPC ..... G03G 15/0849; G03G 15/086
See application file for complete search history.

(56) References Cited

U.S. PATENT DOCUMENTS

2003/0219265 A1* 11/2003 Matsumoto ..... G03G 15/0856 399/38
2004/0156645 A1* 8/2004 Nakazato ..... G03G 15/0849 399/27
2013/0266329 A1* 10/2013 Otani ..... G03G 15/0849 399/27
2015/0016829 A1* 1/2015 Watanabe ..... G03G 15/0856 399/27

(Continued)

FOREIGN PATENT DOCUMENTS

JP S59-051360 U 3/1984
JP 2000-098728 A 4/2000

(Continued)

*Primary Examiner* — Carla J Therrien
(74) *Attorney, Agent, or Firm* — Canon U.S.A., Inc. IP Division

(57) ABSTRACT

An image forming apparatus includes an agitating member, a first electrode, a second electrode disposed with a gap from the first electrode such that the gap has a smallest portion located below a rotation center of the agitating member and a remote portion wider than the smallest portion and located above the smallest portion, and a frame body having a first wall surface having the first electrode disposed thereon and a second wall surface having the second electrode disposed thereon, and a developer detecting unit configured to detect an amount of developer from an output value output in accordance with a capacitance formed between the first electrode and the second electrode. The image forming apparatus performs correction and detects the amount of developer.

30 Claims, 21 Drawing Sheets

(56) References Cited

U.S. PATENT DOCUMENTS

| | | | | |
|---|---|---|---|---|
| 2015/0086228 | A1* | 3/2015 | Noguchi | G03G 15/0889 399/27 |
| 2016/0223950 | A1* | 8/2016 | Kato | G03G 15/086 |
| 2018/0143564 | A1* | 5/2018 | Asanuma | G03G 15/086 |
| 2018/0143584 | A1* | 5/2018 | Nosho | G03G 21/1652 |

FOREIGN PATENT DOCUMENTS

| | | | |
|---|---|---|---|
| JP | 2000-206774 | A | 7/2000 |
| JP | 2001-117346 | A | 4/2001 |
| JP | 2001134064 | A | 5/2001 |
| JP | 2002132030 | A | 5/2002 |
| JP | 2002-323791 | A | 11/2002 |
| JP | 2003-248371 | A | 9/2003 |
| JP | 2003-323036 | A | 11/2003 |
| JP | 2006-301264 | A | 11/2006 |
| JP | 2007-121646 | A | 5/2007 |
| JP | 2011-013638 | A | 1/2011 |
| JP | 2015064441 | A | 4/2015 |
| JP | 2016053689 | A | 4/2016 |

* cited by examiner

IMAGE FORMING APPARATUS HAVING A DEVELOPER DETECTING UNIT

BACKGROUND

Field of the Disclosure

The present disclosure relates to an electrophotographic or electrostatic image forming apparatus, such as a copying machine, a printer, or a facsimile machine, and a developer container unit used by the image forming apparatus.

Description of the Related Art

Existing electrophotographic image forming apparatuses include a development device for forming a developed image by supplying a developer to an electrostatic latent image formed by scan-exposing an image bearing member. In addition, in recent years, many electrophotographic image forming apparatuses have included a process cartridge having a development device including a developer container unit having a developer, an image bearing member, and other process units (e.g., a charging member) integrated thereinto. By integrating a plurality of members into a process cartridge in this manner and allowing the process cartridge to be removable from the main body of the image forming apparatus, replenishment of developer and other maintenance work can be easily performed.

In such a process cartridge system, when the developer runs out, the user can replace the cartridge or refill the cartridge with new developer to form an image again. For this reason, in general, such image forming apparatuses include a unit for detecting consumption of the developer and warning the user of the replacement time, that is, a developer detecting unit.

As an example of such a developer detecting unit, Japanese Patent Laid-Open No. 2001-117346 describes a developer detecting unit that includes a pair consisting of an input electrode and an output electrode and that detects the amount of developer by measuring the capacitance between the two electrodes.

In addition, Japanese Patent Laid-Open No. 2003-248371 and Japanese Patent Laid-Open No. 2007-121646 describe a configuration in which a developer bearing member is regarded as an input electrode by applying an AC bias to a developer bearing member, and a capacitance detection member serving as an output electrode is disposed at a position facing the developer bearing member in a development device.

Each of Japanese Patent Laid-Open Nos. 2001-117346, 2003-248371, and 2007-121646 describes a technique for detecting the amount of developer by using a change in capacitance caused by a change in the amount of developer between a pair of electrodes.

To detect the current amount of developer, it is desirable that the amount of developer be detected even immediately before the developer completely runs out. Therefore, in a technique for detecting the amount of developer by using a change in capacitance, to easily detect a change in the amount of developer even when the amount of developer is small, it is desirable that the arrangement of the electrodes and the shape of members around the electrodes be optimized. However, in a configuration that enables a change in the amount of developer to be easily detected even when the amount of developer is small, it is sometimes difficult to accurately detect the amount of developer.

SUMMARY

According to an aspect of the present application, an image forming apparatus includes a developer container unit including an agitating member configured to rotate and agitate developer, a first electrode, a second electrode disposed to face the first electrode with a gap therebetween such that the gap has a smallest portion located below a rotation center of the agitating member and a remote portion wider than the smallest portion and located above the smallest portion, and a frame body configured to contain the agitating member and the developer and have a first wall surface having the first electrode disposed thereon and a second wall surface having the second electrode disposed thereon, and a developer detecting unit configured to detect an amount of the developer by using an output value output in accordance with a capacitance formed between the first electrode and the second electrode, the developer detecting unit capable of detecting a first amount of developer and a second amount of developer that is smaller than the first amount of developer. When the output value corresponding to the first amount of developer is defined as a first reference value and a value having a first difference from the first reference value is defined as a second reference value indicating a magnitude of the output value corresponding to the second amount of developer, the first difference varies in accordance with a magnitude of the first reference value.

According to another aspect of the present application, an image forming apparatus includes a developer container unit including an agitating member configured to rotate and agitate developer, a first electrode, a second electrode disposed to face the first electrode with a gap therebetween such that the gap has a smallest portion located below a rotation center of the agitating member and a remote portion wider than the smallest portion and located above the smallest portion, and a frame body configured to contain the agitating member and the developer and have a first wall surface having the first electrode disposed thereon and a second wall surface having the second electrode disposed thereon, and a developer detecting unit configured to detect an amount of the developer by using an output value output in accordance with a capacitance formed between the first electrode and the second electrode. The developer detecting unit corrects the output value on the basis of at least one of a rotational speed of the agitating member, an ambient temperature, an ambient humidity, and a deterioration degree of the developer and detects the amount of developer.

Further features of the present disclosure will become apparent from the following description of exemplary embodiments with reference to the attached drawings.

DESCRIPTION OF THE EMBODIMENTS

First Exemplary Embodiment

Figure 1:
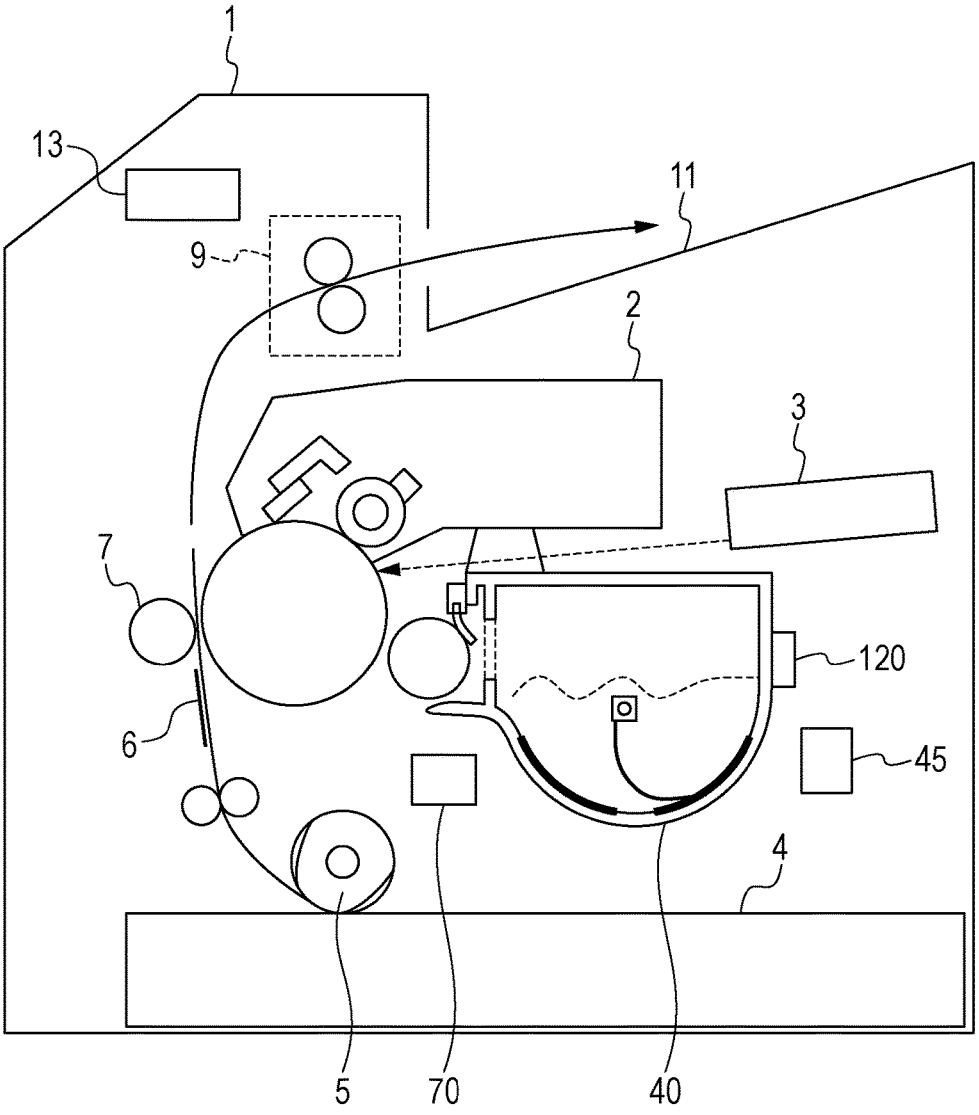
FIG. 1 is a cross-sectional view of an image forming apparatus according to one or more aspects of the present disclosure.

Overview of Configuration and Operation of Image Forming Apparatus and Process Cartridge FIG. 1 is a schematic illustration of an image forming apparatus according to the present exemplary embodiment. The image forming apparatus is an electrophotographic laser beam printer having a removable process cartridge. When an external host apparatus, such as a personal computer or an image reading device, is connected to the image forming apparatus, the image forming apparatus can receive image information and print the image information.

Figure 2:
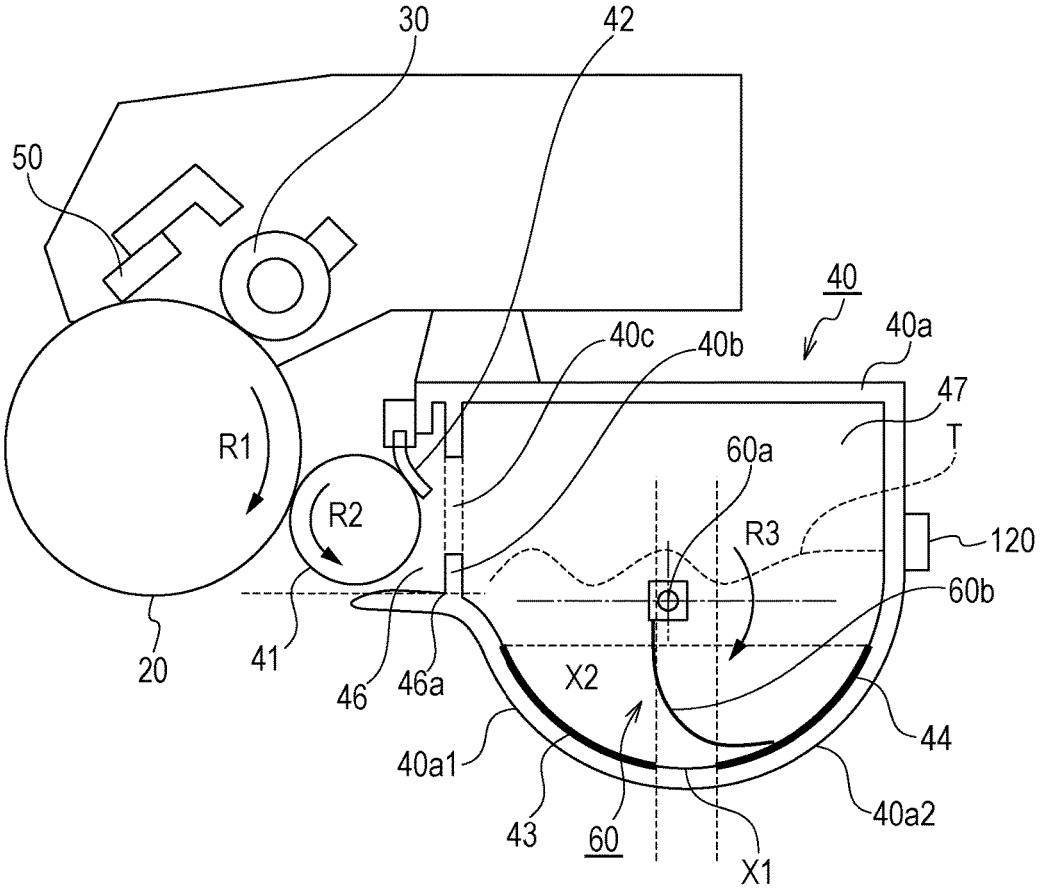
FIG. 2 is a cross-sectional view of a process cartridge according to one or more aspects of the present disclosure.

The image forming apparatus has a printer main body (an apparatus main body) 1. A process cartridge 2 is removably mounted in the apparatus main body 1. FIG. 2 is a cross-sectional view of the process cartridge according to the first exemplary embodiment. The process cartridge 2 is described below with reference to FIG. 2.

A photoconductive drum 20 is a drum-shaped electrophotographic photosensitive member serving as an image bearing member. According to the present exemplary embodiment, four types of process members, that is, the photoconductive drum 20, a charging member (a charging roller) 30, the development device 40 serving as a developer container unit, and a cleaning member (a cleaning blade) 50 are integrated into a process cartridge, which is removable from the apparatus main body 1.

The photoconductive drum 20 is rotationally driven in the clockwise direction of an arrow R1 at a circumferential speed (a process speed) of 200 mm/s in response to a print start signal. A charging roller 30 is in contact with the photoconductive drum 20. A charging bias is applied to the charging roller 30. The charging roller 30 is rotationally driven by the photoconductive drum 20 that is rotating. The circumferential surface of the rotating photoconductive drum 20 is uniformly charged by the charging roller 30 so as to have a predetermined polarity and a predetermined potential. According to the present exemplary embodiment, the circumferential surface is charged so as to have to a negative predetermined potential.

The charged surface is subjected to laser scanning exposure based on image information by an exposure device (a scanner unit) 3. A laser beam output from the scanner unit 3 enters the cartridge and exposes the surface of the photoconductive drum 20. The photoconductive drum 20 is grounded, and the potential of the portion irradiated with the laser beam (the exposed bright portion) is attenuated, and an electrostatic latent image corresponding to the image information is formed on the photosensitive drum. According to the present exemplary embodiment, an image area exposure technique for exposing the image information area is employed.

The electrostatic latent image is developed with a developer (toner) T provided on a developing sleeve (a developing roller) 41 serving as a developer bearing member of the development device 40.

In addition, at a predetermined control time point, a pickup roller 5 of a sheet tray unit 4 is driven, and one recording material (e.g., a sheet of paper) which is a recording medium stacked and stored in the sheet tray unit 4 is fed. The recording material passes through a transfer roller 7 via a transfer guide 6. At this time, the toner image on the surface of the photoconductive drum 20 is sequentially and electrostatically transferred to the surface of the recording material. Thereafter, the recording material having the toner image transferred thereon reaches a fixing device 9. After the toner image is fixed by the fixing device 9, the recording material is output to an output tray 11. After the recording material is separated from the photoconductive drum, residual toner, for example, is removed from the photoconductive drum by the cleaning blade 50. Thus, the photoconductive drum is cleaned. Thereafter, the photoconductive drum is repeatedly used for image formation that starts from charging.

A memory 120 serving as a storage unit is mounted in the process cartridge 2 and stores, for example, a table used for development and charge control needed for image formation. Note that according to the present exemplary embodiment, the memory 120 may be mounted in the apparatus main body 1. Alternatively, the memory 120 may be mounted in each of the process cartridge 2 and the apparatus main body 1. The memory 120 stores correction values used for correction at the time of detecting the amount of developer (described below). The details are described below.

Development Device

Figure 3:
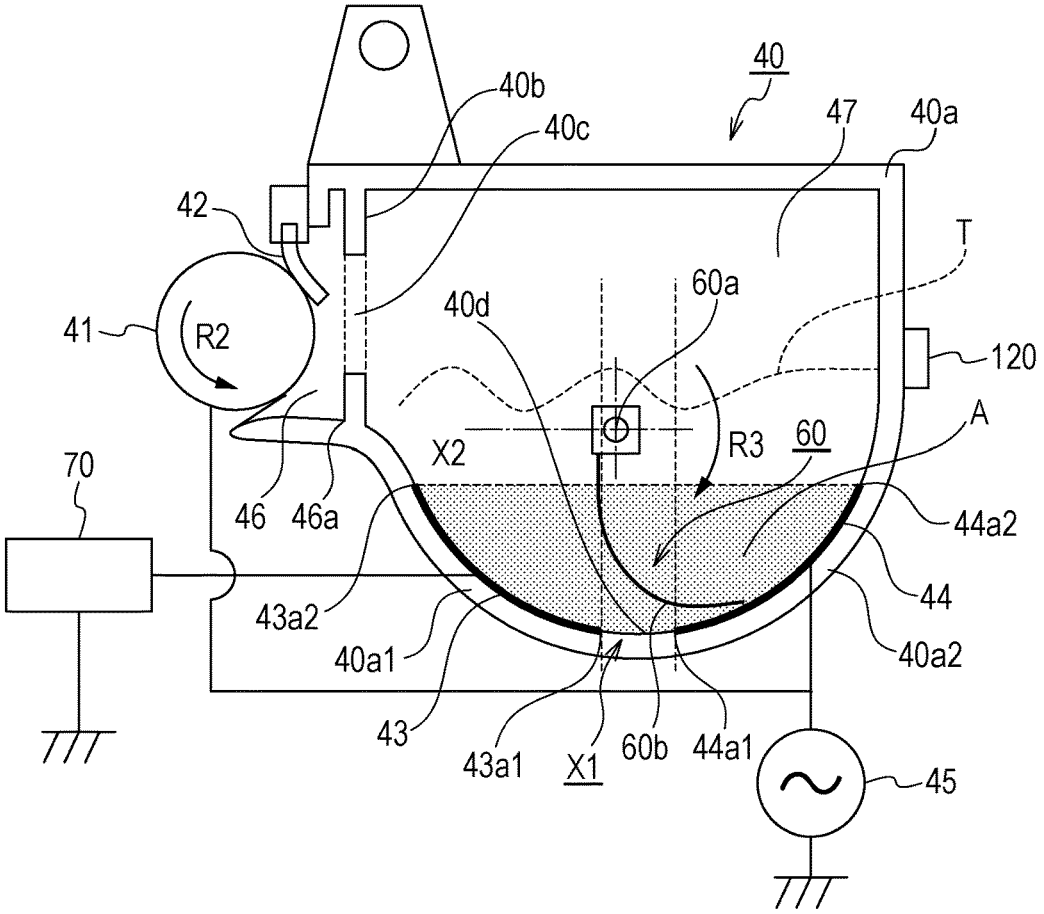
FIG. 3 is a cross-sectional view of a development device (a developer container unit) according to one or more aspects of the present disclosure.

The development device according to the first exemplary embodiment is described with reference to FIG. 3. FIG. 3 is a cross-sectional view of the development device according to the first exemplary embodiment.

According to the present exemplary embodiment, the development device 40 has a frame body 40*a* that contains the toner T. Inside the frame body 40*a*, a partition wall 40*b* is provided. The partition wall 40*b* partitions the inner space of the frame body 40*a* into a developing chamber 46 that rotatably contains the developing roller 41 and a developer containing chamber (hereinafter referred to as a developer chamber) 47 that contains the toner T and an agitating member 60. The partition wall 40*b* has an opening 40*c* that allows the developing chamber 46 to communicate with the developer chamber 47. According to the present exemplary embodiment, the development device 40 is configured as a development device (a development unit) separated from a cleaning unit including the photoconductive drum 20 and the cleaning blade 50.

Pulverized toner of one magnetic component is used as the toner T. The toner T is composed of mother particles and external additive particles. The central particle size of the mother particle is 7 μm, the degree of circularity is 0.95, and the specific gravity is 1.8. To ensure excellent flowability and chargeability, silica having a small particle size is used for the external additive particles in an amount of 0.5% by weight.

The toner T in the developer chamber 47 is conveyed from the developer chamber 47 to the developing chamber 46 through the opening 40*c* by an agitating member 60. The toner T in the developing chamber 46 is attracted to the developing roller 41 by a magnet embedded in the developing roller 41. In addition, a developing blade 42 made of an elastic member and serving as a layer-thickness-regulating member is in contact with the developing roller 41. The toner T is conveyed in the direction of the developing blade 42 with the rotation of the developing roller 41 in an R2 direction. Thereafter, triboelectricity is applied to the toner T by the developing blade 42, and the layer thickness is regulated.

At this time, a developing bias is generated by a developing bias power supply 45 of the image forming apparatus main body that superimposes, on a DC voltage (Vdc=−400 V), an AC voltage (the peak-to-peak voltage=1500 Vpp, a frequency f=2400 Hz), and the developing bias is applied to the developing roller 41. In addition, as described above, the electrostatic latent image is formed on the surface of the photoconductive drum 20. Since an electric field is generated in the region of the photoconductive drum 20 facing the developing roller 41, the toner T having the above-described triboelectricity is supplied to the portion of the photoconductive drum 20 having the electrostatic latent image formed thereon. In this manner, the electrostatic latent image on the surface of the photoconductive drum 20 is developed.

Development Device and Developer Detecting Unit

The development device according to the first exemplary embodiment is described in more detail below with reference to FIG. 3.

According to the present exemplary embodiment, the frame body 40*a* that forms the developer chamber 47 includes an agitating member 60, a planar first electrode 43, and a planar second electrode 44 (inside the developer chamber 47). The developing bias power supply 45 is connected to the second electrode 44 and the developing roller 41. In addition, a developer detecting unit 70 (described below) is connected to the first electrode 43. When a voltage is applied to the second electrode 44 and the developing roller 41, the developer detecting unit 70 can detect the amount of developer on the basis of a change in the combined capacitance of the capacitance between the first electrode 43 and the second electrode 44 and the capacitance between the first electrode 43 and the developing roller 41.

The first electrode 43 and the second electrode 44 that form the electrode pair according to the present exemplary embodiment are disposed on a wall surface of the frame body 40*a* (an inner wall surface 40*a*1 (corresponding to a first wall surface) and an inner wall surface 40*a*2 (corresponding to a second wall surface)). The second electrode 44 is disposed so as to have a gap from the first electrode 43 and face the first electrode 43 in an inclined manner. In addition, the first electrode 43 and the second electrode 44 are disposed so that a smallest portion X1 of the gap between the first electrode 43 and the second electrode 44 (a smallest portion on the wall surface) is formed below a rotation center 60*a* of the agitating member 60 (on the lower side in the direction of gravity). Note that the smallest portion X1 is a portion of a gap between a lower portion 43*a*1 of the first electrode 43 and a lower portion 44*a*1 of the second electrode 44 in the direction of gravity. In addition, the first electrode 43 and the second electrode 44 are disposed so that in the gap between the two electrodes, a remote portion X2, which is wider than the smallest portion X1, is formed above the smallest portion X1 (on the upper side in the direction of gravity). Note that the remote portion X2 is a portion of the gap between an upper portion 43*a*2 of the first electrode 43 and an upper portion 44*a*2 of the second electrode 44 in the direction of gravity. According to the present exemplary embodiment, the width of the smallest portion X1 is 7 mm. In addition, as used herein, an area located between the first electrode 43 and the second electrode 44 and between the smallest portion X1 and the remote portion X2 is referred to as "area A". That is, the area A is a region between the first electrode 43 and the second electrode 44 and between a line extending between the lower portion 43*a*1 and the lower portion 44*a*1 and a line extending between the upper portion 43*a*2 and the upper portion 44*a*2.

Here, the inner wall surface 40*a*1 having the first electrode 43 disposed thereon and the inner wall surface 40*a*2 having the second electrode 44 disposed thereon of the frame body 40*a* are inclined surfaces extending from the smallest portion X1 upward in the gravitational direction so as to be gradually away from each other in the horizontal direction. According to the present exemplary embodiment, the inner wall surface 40*a*1 and the inner wall surface 40*a*2 are curved surfaces. In addition, the first electrode 43 and the second electrode 44 are disposed along the inner wall surface 40*a*1 and the inner wall surface 40*a*2 and are in contact with the inner wall surface 40*a*1 and the inner wall surface 40*a*2, respectively. That is, the smallest portion X1 is located at the lowermost position in the developer chamber 47, and the bottom portion of the developer chamber 47 (the lowermost portion in the gravity direction) is exposed to the inside of the developer chamber 47 through the smallest portion X1. In addition, according to the present exemplary embodiment, the smallest portion X1 is located below the opening 40*c* and the lowermost portion 46*a* of the developing chamber 46 (on the lower side in the direction of gravity).

By setting the first electrode 43, the second electrode 44, and the wall surfaces of the frame body 40*a* as described above, particles of the toner T tend to gather in the smallest portion X1 even when a small amount of the toner T remains. In addition, the area A can be increased and, thus, the amount of developer can be detected from the time point when the amount of developer is large.

In addition, the agitating member 60 includes a flexible sheet-like stirring portion 60*b* and a shaft which rotates about the rotation center 60*a* in a direction of an arrow R3 in FIG. 2. The agitating member 60 is disposed so that the rotation center 60*a* overlaps the position of the smallest portion X1 in the horizontal direction. That is, the agitating member 60 is disposed so that the rotation center 60*a* is located within the smallest portion X1 in the horizontal direction. In addition, the rotation center 60*a* is provided on the lower side with respect to the opening 40*c* in the direction of gravity. The stirring portion 60*b* rotates so as to pass through the above-mentioned smallest portion X1 and is in slide contact with a wall surface 40*d* exposed through the smallest portion X1. Thereafter, the stirring portion 60*b* scoops up the toner T in the smallest portion X1 toward the opening 40*c* and supplies the toner T to the developing chamber 46. When the agitating member 60 further rotates, the toner T on the stirring portion 60*b* drops from the stirring portion 60*b* onto the inner wall surface 40*a*1 and the inner wall surface 40*a*2 by gravity and returns to the smallest portion X1. By using such a configuration, even when a small amount of the toner T remains, the toner T tends to gather in the smallest portion X1. In addition, the agitating member 60 can actively transports the toner in the area A including the smallest portion X1.

In addition, the first electrode 43 and the second electrode 44 need only have conductivity, and a metal plate can be used. However, according to the present exemplary embodiment, a sheet member made of a conductive resin is used. In addition, according to the present exemplary embodiment, the first electrode 43 and the second electrode 44 are integrally molded into the frame body 40*a* (known as "insert molding"). That is, the first electrode 43 is in tight contact with and the frame body 40*a* (the inner wall surface 40*a*1), and the second electrode 44 is in tight contact with the frame body 40*a* (the inner wall surface 40*a*2). Thus, the toner T does not enter therebetween.

Note that according to the present exemplary embodiment, the first electrode 43 and the second electrode 44 are disposed on the inner wall surface of the frame body 40*a*. However, the first electrode 43 and the second electrode 44 may be disposed on the outer side of the frame body 40*a*.

Figure 4:
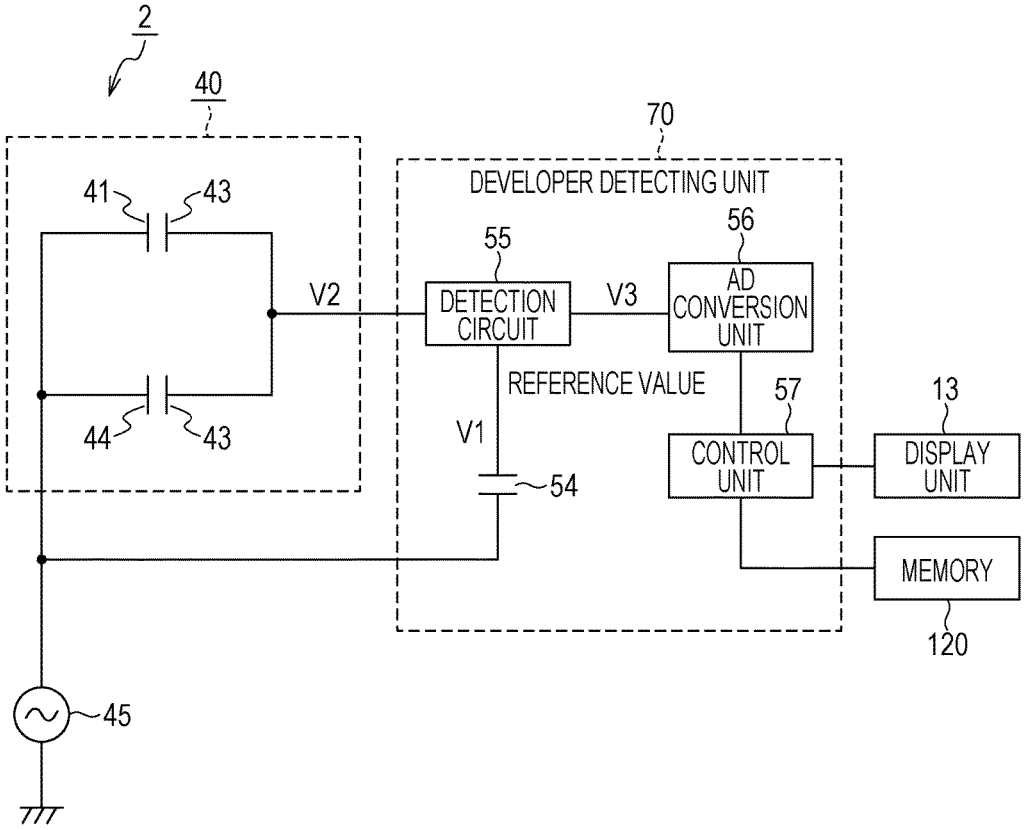
FIG. 4 illustrates a developer amount detection circuit according to one or more aspects of the present disclosure.

The development device and the developer detecting unit according to the first exemplary embodiment are described below with reference to FIG. 4. FIG. 4 is a circuit configuration diagram of the development device and the developer detecting unit according to the first exemplary embodiment.

When a predetermined AC bias is output from the developing bias power supply 45, the AC bias is applied to each of a reference capacitor 54, the developing roller 41, and the second electrode 44. As a result, a voltage V1 is generated in the reference capacitor 54, and a voltage V2 is generated in the first electrode 43 in accordance with a current corresponding to the combined capacitance. A detection circuit 55 generates a detection voltage V3 from the voltage difference between V1 and V2 and outputs the detection voltage V3 to an AD conversion unit 56. That is, V3 is an output value that is output in accordance with the capacitance between the first electrode 43 and the second electrode 44. The AD conversion unit 56 outputs, to a control unit 57, the result of digital conversion of the analog voltage. The control unit 57 calculates the amount of developer by using the result of digital conversion, stores the result of calculation in the memory 120, and displays information about the remaining amount of developer on a display unit 13. Note that the display unit 13 may read the result of calculation from the memory 120 and display the read result.

That is, the developer detecting unit 70 detects the capacitance between the first electrode 43 and the second electrode 44 and calculates the amount of the developer in the development device 40 (the developer container unit) on the basis of the capacitance. In addition, according to the present exemplary embodiment, the developer detecting unit 70 can detect the amount of developer when the amount of toner is sufficiently large as a first amount of developer and detect the amount of developer when the toner is about to run out as a second amount of developer. Furthermore, according to the present exemplary embodiment, the developer detecting unit 70 can detect a third amount of developer that is smaller than the first amount of developer and is larger than the second amount of developer. That is, the amount of developer that decreases as the development device 40 is used can be successively calculated. Calculation of the amount of developer on the basis of the capacitance is described below.

In addition, according to the present exemplary embodiment, the AC bias for detecting the amount of developer is applied to the developing roller 41 and the second electrode 44. However, for example, even when the AC bias is not applied to the developing roller 41, the effect of the present exemplary embodiment can be obtained. Alternatively, the AC bias may be applied to the first electrode 43 to cause the second electrode 44 to generate a voltage. According to the present exemplary embodiment, the first electrode 43 is disposed between the developing roller 41 and the second electrode 44 to which the AC bias is applied. In this manner, a change in capacitance between the developing roller 41 and the first electrode 43 and a change in capacitance between the second electrode 44 and the first electrode 43 can be detected as a change in the combined capacitance.

Figure 5:
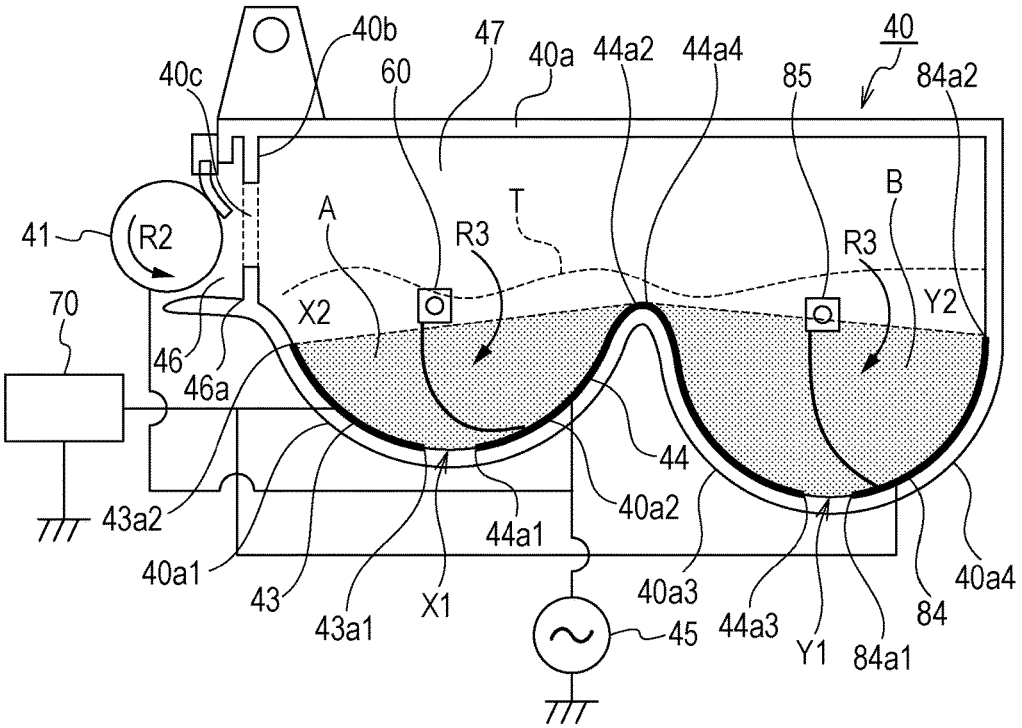
FIG. 5 is a cross-sectional view of a development device (a developer container unit) according to one or more aspects of the present disclosure.

In addition, as illustrated in FIG. 5, for example, a configuration including a plurality of agitating members and a plurality of electrode pairs can be employed. In this case, the first electrode 43 and the second electrode 44 are disposed so that the smallest portion X1 and the area A are formed below the agitating member 60. The second electrode 44 extends beyond the inner wall surface 40*a*2 to an inner wall surface 40*a*3. In addition, a third electrode 84 is disposed on an inner wall surface 40*a*4 below an agitating member 85. At this time, when viewed from the upper portion 43*a*2 of the first electrode 43, the distance between the upper portion 44*a*2 of the second electrode 44 and the upper portion 43*a*2 is the width of the remote portion X2. Similarly, when viewed from an upper portion 84*a*2 of the third electrode 84, the distance between the upper portion 84*a*2 and an upper portion 44*a*4 of the second electrode 44 is the width of a remote portion Y2. The distance between a lower portion 84*a*1 of the third electrode 84 and a lower portion 44*a*3 of the second electrode 44 is the width of a smallest portion Y1. Note that in FIG. 5, area B is defined similarly to area A. The inner wall surface 40*a*3 corresponds to the inner wall surface 40*a*1. The inner wall surface 40*a*4 corresponds to the inner wall surface 40*a*2.

In such a configuration, the toner T is finally collected in the smallest portion X1 due to the rotation of the agitating member 60 and the agitating member 85. In addition, in the configuration (X1, Y1) having a plurality of the smallest portions as described above, if the smallest portion X1 closest to the developing chamber 46 is located on the lower side with respect to the developing chamber 46 and the opening 40*c* in the gravity direction, the effect of collecting the toner in the smallest portion X1 can be easily obtained.

In this manner, even a frame body having a larger capacity can accurately detect the amount of developer. In the above example, the amount of developer is detected on the basis of the combined capacitance of the first electrode 43 and the third electrode 84. However, a plurality of the developer detecting units 70 may be provided, and the values detected by the first electrode 43 and the third electrode 84 may be separately processed. As a result, the amount of developer can be detected in more detail.

The following description is given with reference to a single agitating member and a single electrode pair.

Developer Amount Detection

Detection of the amount of developer according to the present exemplary embodiment is described in detail below.

As described above, according to the present exemplary embodiment, the development device 40 includes the agitating member 60. The agitating member 60 is disposed so as to pass through area A formed between the first electrode 43 and the second electrode 44. In addition, according to the present exemplary embodiment, the amount of developer is detected by using a change in the combined capacitance of the capacitance between the first electrode 43 and the second electrode 44 and the capacitance between the first electrode 43 and the developing roller 41. The change in the combined capacitance occurs when the amount of developer changes. Accordingly, when the toner T moves due to the agitating member 60 being driven rotationally, the obtained output is as if the amount of developer has changed, even though the amount of developer in the development device 40 has not changed.

Therefore, according to the present exemplary embodiment, the output of the capacitance value is acquired at fixed time intervals (sampling intervals), and the acquisition of the output continues for an integral multiple of the rotation cycle of the agitating member 60 or for a sufficiently long time. Thereafter, the average of the capacitance values is calculated as an output value. In addition, the relationship between the output value and the amount of developer is obtained in advance. The obtained relationship is stored in the memory 120 in the form of a table or a conversion formula. Thereafter, the amount of developer is calculated on the basis of the output value acquired at the time of image formation using one of the above-described table and conversion formula. That is, the technique for detecting the amount of developer according to the present exemplary embodiment is a technique of calculating the amount of developer in the entire developer container on the basis of the state in which the toner in the area A is being agitated by the agitating member 60.

It is desirable to detect the amount of developer over a wide time range covering from when the amount of the toner T in the development device 40 is large to when the amount of the toner T is small. In contrast, it is generally desirable that the accuracy of the detection be particularly high when the amount of developer is small, since one of the main objectives of detecting the amount of developer is to determine whether the user should replace the cartridge or the development device. Therefore, according to the present exemplary embodiment, by increasing a change in capacitance per unit of change in amount of toner especially when the amount of developer is small, the accuracy of detection of the amount of developer is increased when the amount of developer is small.

The amount of toner can be detected more accurately with increasing amount of change in the output value per unit of change in amount of developer, that is, increasing amount of change in capacitance. Conversely, it can be said that for example, the accuracy of detection of the amount of developer is low if the capacitance changes only slightly when the amount of developer changes. Note that it is known that the relationship among the capacitance C, the area S of the two electrodes, the distance d, and the dielectric constant ε is given as follows:

$$C=\varepsilon\times S/d \quad (1).$$

Among these parameters, the dielectric constant s varies with the amount of developer existing between the electrodes, and the dielectric constant s increases with increasing amount of the developer.

Here, according to equation (1), the capacitance increases with decreasing distance d when the dielectric constant remains unchanged. That is, the change in the dielectric constant that occurs in a region where the distance d is small has a large contribution to the change in the overall capacitance. In contrast, the change in the dielectric constant that occurs in a region where the distance d is large has a small contribution to the change in the overall capacitance.

Therefore, in the smallest portion X1 and the surrounding vicinity illustrated in FIG. 3, the contribution of a change in the dielectric constant ε due to a change in the amount of the toner T between the electrodes to the change in the capacitance is large. That is, the smallest portion X1 and the surrounding vicinity is sensitive to a change in the amount of the toner T. In addition, the contribution of an upper portion of the area A to a change in capacitance is relatively small when the dielectric constant ε changes due to a change in the amount of the toner T between the electrodes.

As described above, according to the present exemplary embodiment, the configuration is designed to enable the toner T to be easily accumulated in the smallest portion X1 when the amount of the developer is small. In addition, by specifying the positioning of the smallest portion X1 where a change in capacitance is large below the agitator shaft, the toner drops to the smallest portion X1 and the surrounding vicinity due to its own weight even when the agitating member 60 is operating. Accordingly, the capacitance changes greatly with the change in the amount of developer.

As a result, the accuracy of detection of the amount of developer can be increased particularly when the amount of developer is small. At the same time, the change in the amount of developer can be detected in a wide range of the amount.

The configuration of the present exemplary embodiment is more desirable, since the smallest portion X1 is disposed on the lowermost wall surface of the developer chamber 47 and, thus, the capacitance changes greatly even when the toner dropped from the agitating member 60 is very small. However, the effect of the present disclosure can be similarly obtained if the smallest portion X1 is disposed below the rotation center 60*a* even though the smallest portion X1 is not disposed on the lowermost wall surface.

Figure 6:
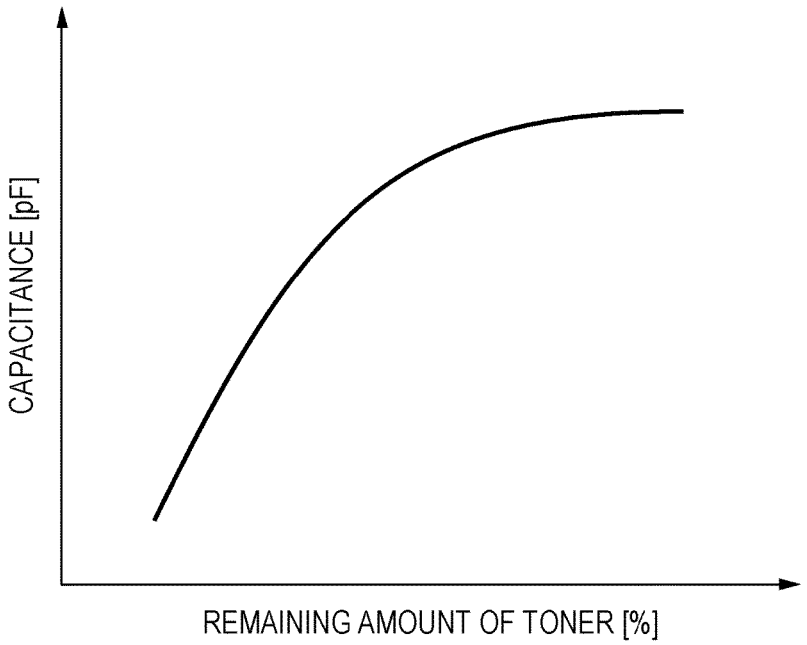
FIG. 6 illustrates the amounts of developer and corresponding capacitance values according to one or more aspects of the present disclosure.

FIG. 6 is a diagram illustrating the relationship between the amount of developer and the average of the capacitance values according to the present exemplary embodiment. As described above, according to the present exemplary embodiment, even when the amount of developer is small, the toner is collected in the smallest portion X1 having a high capacitance contribution ratio during the agitating operation and is agitated. In the case where the remaining amount of the toner is sufficiently large with respect to the area A, even if the amount of toner decreases in accordance with image formation, the amount of developer in the area A negligibly changes and, thus, the change in capacitance is small. As the amount of developer decreases, the change in capacitance increases. This is because the amount of toner in the area A decreases by the amount of the developer lifted by the agitating member 60. However, when the toner remains in the smallest portion X1 and the surrounding vicinity having a high detection sensitivity, the amount of change in the capacitance is still small. When the amount of developer further decreases, the capacitance greatly changes. This is because the amount of toner in the smallest portion X1 and the surrounding vicinity having high detection accuracy decreases.

As described above, when the amount of the developer is small, the capacitance changes greatly with a small change in the amount of developer. Thus, the amount of developer can be detected with high accuracy.

Influence of Variation in Developer Detection

Note that the capacitance between the first electrode 43 and the second electrode 44 is influenced by, for example, a variation in the layout of the members and a product-to-product variation. Therefore, if the amount of developer is calculated directly from the absolute value of the capacitance between the first electrode 43 and the second electrode 44, it may be difficult to accurately detect the amount of developer. For this reason, the developer detecting unit 70 according to the present exemplary embodiment defines, as a first reference value, the capacitance detected when the development device 40 having a sufficient amount of toner (the first amount of developer) therein is mounted in the apparatus main body 1. Thereafter, the image forming apparatus calculates the amount of developer on the basis of the amount of change in capacitance from the first reference value. The calculation is described in more detail below.

According to the present exemplary embodiment, since the first electrode 43 and the second electrode 44 are integrally molded into the frame body 40*a* of the development device 40, the shapes of the first electrode 43 and the second electrode 44 are determined by the shape of the frame body 40*a*. Therefore, a variation in distance between both electrodes due to the shapes of the first electrode 43 and the second electrode 44 is small. The same also applies to the case where the first electrode 43 and the second electrode 44 are bonded to the frame body 40*a*.

However, since the relative positional variation of the first electrode 43 and the second electrode 44 (a variation due to the molding position or the bonding position) sometimes occurs, it is necessary to take such a variation into consideration.

If the positions of the first electrode 43 and the second electrode 44 vary, the width of the smallest portion X1 may vary, for example. If a variation of the width of the smallest portion X1 occurs, a variation in the capacitance occurs according to equation (1). Thus, the capacitance varies. According to the present exemplary embodiment, by determining the shape of the developer container and the arrangement of the first electrode 43 and the second electrode 44 as illustrated in FIG. 3, the remaining amount of toner is detected with high accuracy in a wide range of the amount. However, by reflecting the influence of such variations in detection of the amount of developer, the influence of the variation in the width of the smallest portion X1 can be reduced. As a result, the amount of toner can be more accurately detected.

In addition, according to the present exemplary embodiment, the first electrode 43 and the second electrode 44 are sheet members made of a conductive resin. Furthermore, the first electrode 43 and the second electrode 44 are integrally molded into the frame body 40*a* (known as insert molding). In this case, depending on the conditions at the time of molding, the sheet member may expand due to the heat of the resin depending on the conditions of molding. Accordingly, even in this case, the effect of reflecting the influence of the variation which is a feature of the present exemplary embodiment can be significant.

As described above, according to equation (1), the detection sensitivity to a change in the amount of developer increases with decreasing width of the smallest portion X1. That is, in the development device 40 according to the present exemplary embodiment, the detection sensitivity is higher in the lower portions of the first electrode 43 and the second electrode 44 than in the upper portions. Similarly, the detection sensitivity is higher when the width of the smallest portion X1 is small than when the width of the smallest portion X1 is large. In addition, when toner is present, the toner moves downward in the direction of gravity, so that the toner density (the weight of developer present per unit space) in the lower portion of the frame body 40*a* is higher than in the upper portion. As described above, the toner density is related to the dielectric constant $\varepsilon$ in equation (1). When the toner density is high, the dielectric constant $\varepsilon$ increases and, thus, the capacitance increases.

That is, according to the configuration of the present exemplary embodiment, the region having a high detection sensitivity and the region having a high toner density coincide with each other. According to the present exemplary embodiment, the configuration is designed to increase the detection sensitivity when the amount of developer is small. However, the configuration tends to increase the influence of a variation of the width of the smallest portion X1 on the detected capacitance.

Note that if toner is not present between the first electrode 43 and the second electrode 44, the capacitance is determined in accordance with the distance between the two electrodes. That is, when the distance between the two electrodes is small, the capacitance is larger than when the distance is large. In particular, when the width of the smallest portion X1 is small, the difference in the capacitance is large.

In the case where the toner is present, the influence of the variation in the distance between the two electrodes on the capacitance is great. That is, the difference in the capacitance detected when the distance between the two electrodes varies is larger than in the case where the toner is not present. In addition, according to the present exemplary embodiment, since the smallest portion X1 having a high detection sensitivity and the region where the toner density tends to be high coincide with each other, the capacitance is easily influenced by the variation.

That is, even when the same change in the amount of toner occurs and, thus, the change in the dielectric constant caused by the change is the same, the change in capacitance when the distance between the two electrodes is small is larger than when the distance between the two electrodes is large.

In other words, the magnitude of the capacitance change from the first reference value (e.g., the capacitance value when the remaining amount of toner is 100%) to the capacitance value when the remaining amount of toner is 0% depends on the distance between the two electrodes and, in particular, the width of the smallest portion X1.

Accordingly, in order to further improve the accuracy of detecting the remaining amount of toner, it is desirable that the width of the smallest portion X1 be reflected in the relationship between the magnitude of the capacitance change and the amount of developer.

Reflection of Influence of Variation in Developer Detection

A method for detecting the amount of developer and a method for reflecting the influence of a variation of the distance between the electrodes (a method for correction based on the distance between the electrodes) are described below. As described above, the developer detecting unit 70 according to the present exemplary embodiment uses the capacitance detected when the remaining amount of the toner is sufficient (the first amount of developer) as the first reference value and calculates the amount of developer on the basis of the magnitude of the capacitance change from the first reference value.

Figure 7:
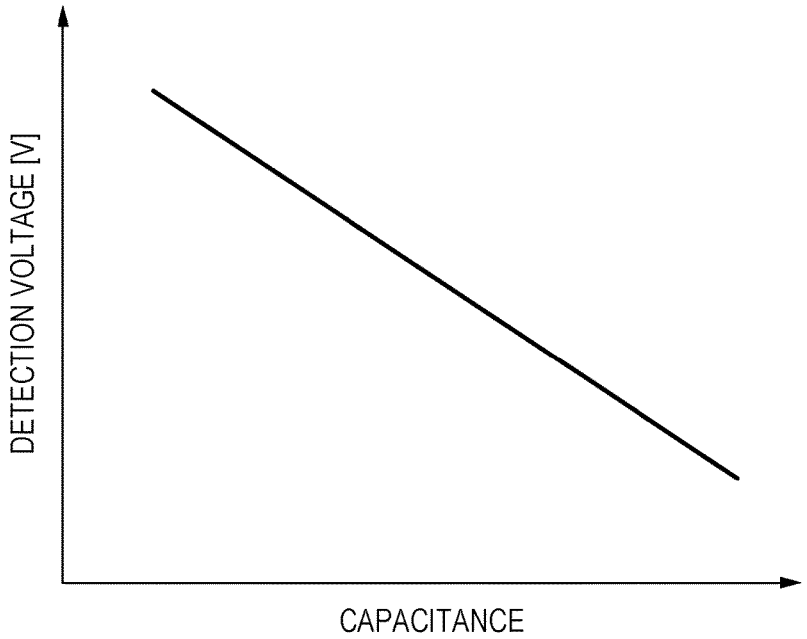
FIG. 7 illustrates the relationship between the capacitance and the detected voltage according to one or more aspects of the present disclosure.

Note that according to the present exemplary embodiment, the capacitance is obtained by measuring the detection voltage V3. In the present configuration, with the conversion circuit, there is an inverse relation between the capacitance and the detected voltage. The configuration is designed such that the detected voltage is low when the detected capacitance is large, and the detection voltage is high when the capacitance is small. FIG. 7 is a schematic illustration of such a relationship. As can be seen from FIG. 7, the capacitance obtained by measuring the detection voltage V3 can be used as the output value for detecting the amount of developer. Alternatively, the capacitance obtained by measuring the detection voltage V3 may be used. Still alternatively, the detection voltage V3 can be directly used.

First, the developer detecting unit 70 defines, as a first reference value, the capacitance detected when the remaining amount of toner is sufficient (the first amount of developer). The first reference value is referred to as "PAF". That is, PAF corresponds to a value indicating the magnitude of the output value output at the time corresponding to the first amount of developer. According to the present exemplary embodiment, PAF is set when the remaining amount of developer is substantially 100%. It is desirable to set PAF after image formation using the development device 40 is performed and the toner in the development device 40 is stable (e.g., the toner is not collected in one part of the development device 40). Therefore, the capacitance detected at a predetermined time point, such as when an unstable region generated at the beginning of use of the development device 40 is removed, is set as PAF corresponding to the first amount of developer. Hereinafter, the time point at which PAF is set is referred to as a "reference time point". For example, the capacitance value detected immediately after the agitating member 60 is driven for a predetermined period of time or immediately after the agitating member 60 is rotated a predetermined number of revolutions can be defined as PAF. Alternatively, the capacitance detected immediately after the image forming operation using the development device 40 is performed a predetermined number of times can be defined as PAF. In such a case, for example, the capacitance detected when the accumulated number of pixels (printed pixels) used for the image forming operations reaches a given value may be defined as PAF. The PAF is stored in the memory 120. Note that PAF is not stored at the time of shipment of the cartridge according to the present exemplary embodiment.

Subsequently, a second reference value is calculated. The second reference value serves as a reference of the magnitude of the capacitance corresponding to the second amount of developer (according to the present exemplary embodiment, the remaining amount of toner of 0%) which is smaller than the amount of developer used to set PAF. According to the present exemplary embodiment, PAF is defined as the first reference value, and a capacitance having a predetermined difference (a first difference) δ from PAF is set. The capacitance is referred to as "PAE" (the second reference value serving as a reference of the magnitude of the capacitance corresponding to the second amount of developer). That is, PAE corresponds to the second reference value indicating the magnitude of the output value corresponding to the second amount of developer.

That is, PAS is a value corresponding to the magnitude of the capacitance obtained by subtracting the difference δ from the PAF. According to the present exemplary embodiment, the difference δ is a value stored in the memory 120. The value δ is estimated as the magnitude of the capacitance change from PAF set at the reference time point to the capacitance value corresponding to the remaining amount of toner of 0% when the width of the smallest portion X1 is equal to the reference distance.

Note that the developer detecting unit 70 according to the present exemplary embodiment can detect a third amount of developer that is smaller than the first amount of developer (the amount of developer at the time of PAF setting) and is larger than the second amount of developer (the amount of developer indicated by PAE).

More specifically, let PA be the capacitance at the time of detecting the third amount of developer (a capacitance obtained from the detection voltage V3 detected during the image forming operation). That is, PA corresponds to the output value at the time point corresponding to the third amount of developer. Then, the difference between PA and PAF is calculated as a second difference. Thereafter, the third amount of developer is detected by using the ratio of the second difference to the difference δ between PAF and PAE (the first difference). The ratio of the second difference to the first difference is referred to as a "PA ratio". That is, the PA ratio is given as follows:

$$PA\ \text{ratio}=(PA-PAF)/(PAE-PAF) \quad (2).$$

The remaining amount of toner can be obtained by referencing a toner remaining amount table (described below) on the basis of the PA ratio.

Figure 8:
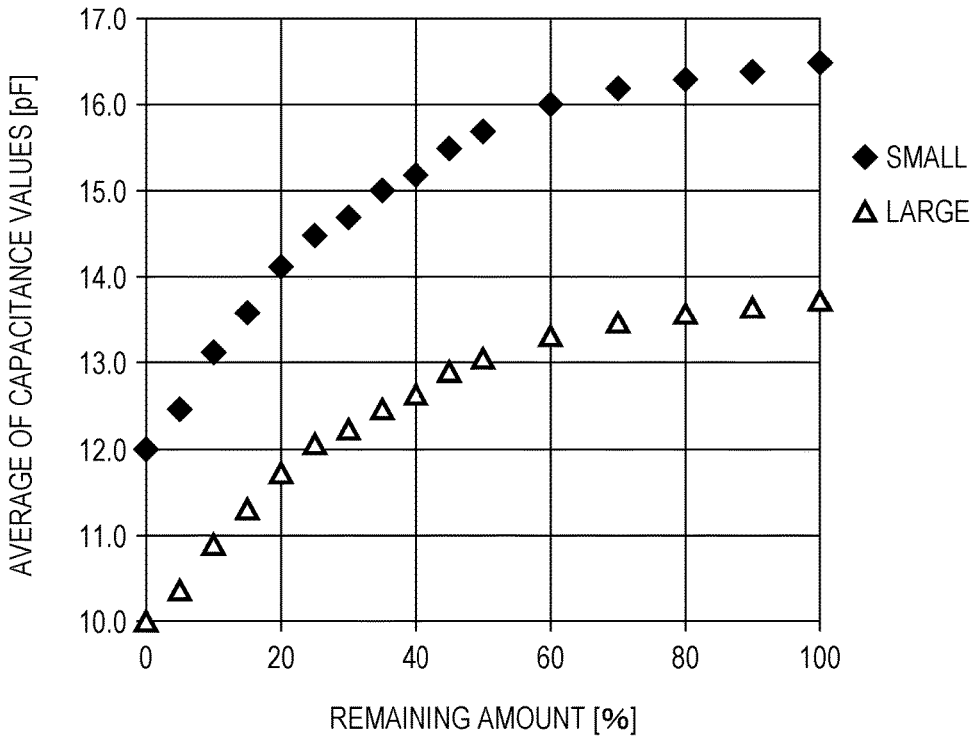
FIG. 8 illustrates a change in the capacitance with respect to a distance between electrodes according to one or more aspects of the present disclosure.

However, as described above, if the width of the smallest portion X1 is not the same as the reference distance, the amount of change from the capacitance at the reference time point to the capacitance corresponding to the remaining amount 0% changes. FIG. 8 is a graph illustrating the relationship between the magnitude of the capacitance change and the amount of developer in the cases where the width of the smallest portion X1 is small and is large. In this case, the reference distance is determined so as to be equal to the width of the smallest portion X1 that is large.

In the case where the width of the smallest portion X1 is small, the average of the capacitance values is 16.5 pF when the remaining amount of toner is 100% and is 12 pF when the remaining amount of toner is 0% (empty). Thus, the magnitude of the capacitance change is 4.5 pF.

In addition, in the case where the width of the smallest portion X1 is large, the average of the capacitance values is 13.7 pF when the remaining amount of toner is 100% and is 10 pF when the remaining amount of toner is 0% (empty). Thus, the magnitude of the capacitance change is 3.7 pF.

Accordingly, it can be seen that when the width of the smallest portion X1 is not the same as the reference distance, a difference occurs in the magnitude of the capacitance change.

Therefore, it is desirable to determine the amount of developer by varying the difference δ from PAF to PAE in accordance with the width of the smallest portion X1. In this manner, the accuracy of detecting the developer can be improved. Note that according to the present exemplary embodiment, the value used at this time is called an inter-electrode correction value P (a value used for calculating the second reference value), and the inter-electrode correction P is stored in the memory 120. A ratio obtained by varying the PA ratio by using the inter-electrode correction value P is called a "PA' ratio". That is, the PA' ratio is obtained by correcting the amount of change from the output value at the reference time point to the output value corresponding to the remaining amount of 0% by using the inter-electrode correction value P.

The difference δ between the output capacitance values at the time point corresponding to a remaining amount of toner of 100% and at the time point corresponding to a remaining amount of toner of 0% is obtained by subtracting PAF from PAE. The magnitude of the difference δ is changed by using the inter-electrode correction value P. Thus, the above-described PA ratio is obtained as a PA' ratio. That is, the PA' ratio is calculated as follows:

$$PA' \text{ ratio}=(PA-PAF)/((PAE-PAF)-P) \quad (3).$$

At this time, according to the present exemplary embodiment, the relationship between PAF and the inter-electrode correction value P is obtained in advance, and the correction value is determined by referencing a table denoting PAF values and corresponding inter-electrode correction values P. That is, the table of the inter-electrode correction value P when the result illustrated in FIG. 8 has been obtained is illustrated in FIG. 9, for example.

The table of the inter-electrode correction value P is described in more detail below with reference to FIGS. 8 and 9. Assuming that the width of the smallest portion X1 is large, a value corresponding to PAF is 13.7 pF (a predetermined value). At this time, the above-mentioned difference δ is 3.7 pF. If the inter-electrode correction value P is not used, the difference δ is the same even when the width of the smallest portion X1 is small. Accordingly, PAE obtained when the width of the smallest portion X1 is small is 12.8 pF, which is obtained by subtracting 3.7 pF from 16.5 pF. However, the capacitance value corresponding to the actual PAE is 12 pF. Therefore, if a PAF of 16.5 pF is detected, the inter-electrode correction value P is set to −0.8 pF by using the table illustrated in FIG. 9, and a correction is performed. Through the correction, the magnitude of the capacitance change from the capacitance when the remaining amount of toner is 100% to the capacitance when the remaining amount of toner is 0% (empty) is changed from 3.7 pF to 4.5 pF. Thus, the offset from the magnitude of the capacitance change is reduced. Since the offset from the magnitude of the capacitance change is reduced, the accuracy of detecting the remaining amount of toner can be increased.

That is, the developer detecting unit 70 sets, as the first reference value (PAF), the detected capacitance corresponding to the first amount of developer at the reference time point. Thereafter, by using the table illustrated in FIG. 9 as an example, the inter-electrode correction value P is obtained on the basis of the value of the PAF. Thereafter, the magnitude of the difference δ is varied in accordance with the inter-electrode correction value P, and a second reference value (PAE) which serves as a reference of the magnitude of the capacitance corresponding to the second amount of developer is calculated. Subsequently, the second amount of developer (the remaining amount of toner of 0%) and the third amount of developer before the second amount of developer is reached are detected on the basis of PAF, PAE, and PA.

Figure 9:
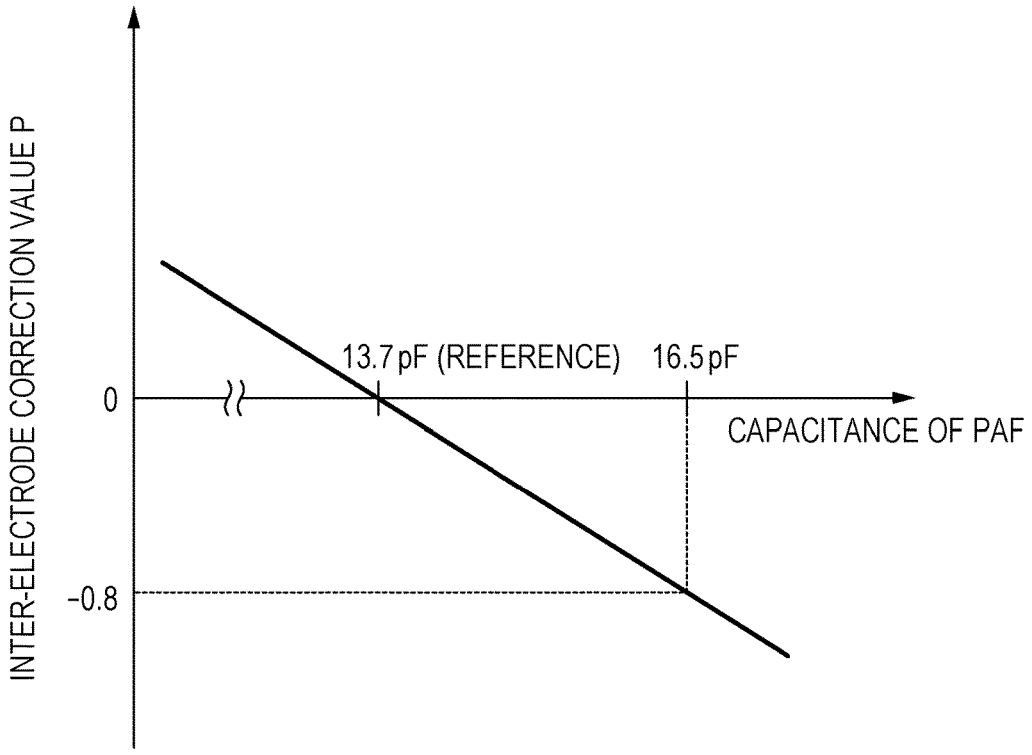
FIG. 9 is a table denoting inter-electrode correction values used in the sequence of detecting the amount of developer according to one or more aspects of the present disclosure.

In addition, as can be seen from FIG. 9, in terms of the variation of the difference δ, the width of the smallest portion X1 decreases with increasing PAF (increasing capacitance). Thus, the developer detecting unit 70 increases the absolute value of the difference δ. In addition, the developer detecting unit 70 varies the difference δ so that the difference between the difference δ and the reference difference δ increases with increasing difference between PAF and the predetermined value (13.7 pF in the case illustrated in FIG. 9 and including the case where PAF is smaller than 13.7 pF).

The method for determining the inter-electrode correction value P is not limited to the method using a table and can be changed as appropriate. For example, a reference PAF value may be stored in advance, and the inter-electrode correction value P may be calculated by using a calculation formula and a difference between the measured PAF value and the reference PAF value. Alternatively, the inter-electrode correction value P may be obtained by multiplication or division with the difference δ. That is, the difference δ may be multiplied by the inter-electrode correction value P or may be divided by the inter-electrode correction value P.

Figure 10:
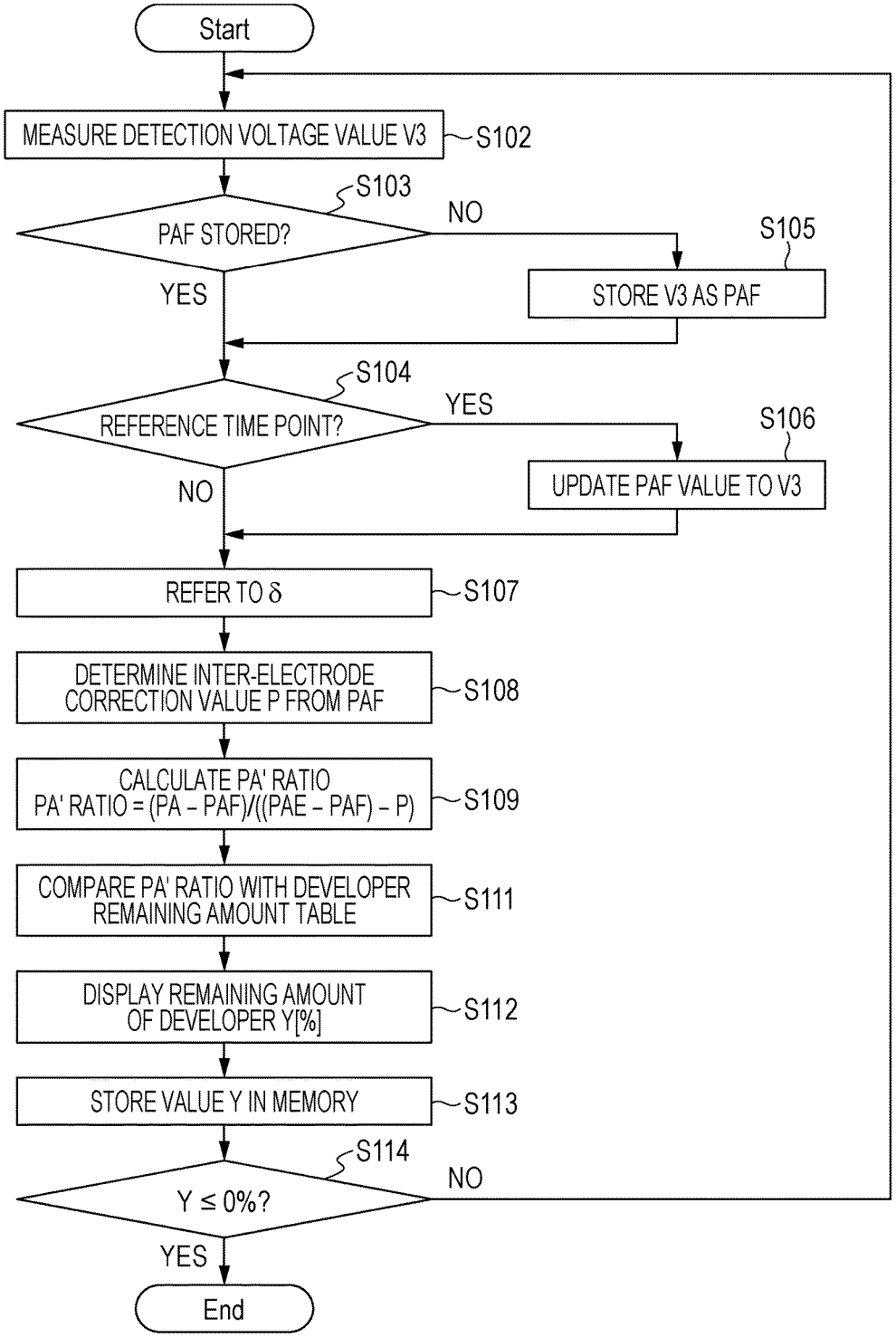
FIG. 10 illustrates the sequence of detecting an amount of developer according to one or more aspects of the present disclosure.

In light the above-described correction, the developer detection sequence is described below with reference to FIG. 10. According to the present exemplary embodiment, the case where the width of the smallest portion X1 is large is taken as a reference.

The detection voltage V3 is measured first (S102). If the PAF value is not stored or if the reference time point is reached, the detection voltage V3 is stored as the PAF value (S103 to S106). That is, in S103, it is determined whether PAF is stored in the memory 120. If YES, the processing proceeds to S104. If NO, the processing proceeds to S105. According to the present exemplary embodiment, PAF is not stored at the time of shipment of the process cartridge. However, a tentative value may be stored at the time of shipment. In S104, it is determined whether the reference time point has been reached. If YES, the processing proceeds to S106. If NO, the processing proceeds to S107. Subsequently, the memory 120 is referenced to obtain the difference δ between PAF and the output value at the time corresponding to a remaining amount of 0% (S107).

Subsequently, from the value of PAF, the inter-electrode correction value P is determined by referencing the table denoting pre-acquired PAF values and corresponding inter-electrode correction values P (S108). As described above, the inter-electrode correction value P is a correction value used to vary the difference from PAF to PAE. The inter-electrode correction value P increases with increasing distance from the width of the smallest portion X1.

Figure 11:
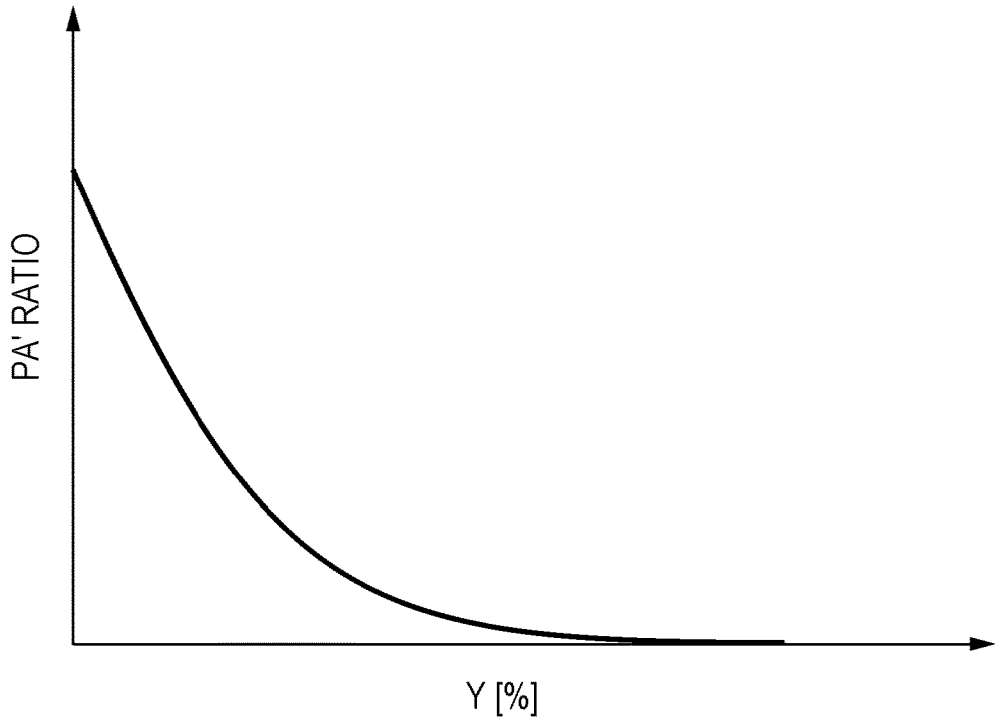
FIG. 11 illustrates an example of a toner remaining amount table according to one or more aspects of the present disclosure.

Subsequently, PA' ratio is calculated by using equation (3) (S109). By comparing the calculated PA' ratio with the developer remaining amount table, the remaining amount of developer (Y %) can be detected (calculated). For example, the table illustrated in FIG. 11 is used as the toner remaining amount table (S111). The determined amount of developer is displayed to notify the user of the remaining amount (S112). By storing the remaining amount of developer in the memory 120 and repeating the detection process until the remaining amount reaches 0% (until it is detected that the third amount of developer is the same as the second amount of developer), the remaining amount can be sequentially detected (S113 to S114).

The PA' ratio is a value obtained by correcting the amount of change in the output value (from the output value at the reference time point to the output value corresponding to a remaining amount of 0%) by using the inter-electrode correction value P in accordance with the width of the smallest portion X1. By performing the correction, the remaining amount can be detected from the amount of change in the output value in accordance with the width of the smallest portion X1 and, thus, the accuracy of detection of the remaining amount can be increased.

As described above, by calculating the inter-electrode correction value in accordance with the reference value and correcting the relationship between the amount of change in capacitance and the amount of developer by using the correction value, the accuracy of detecting the amount of developer can be increased.

According to the present exemplary embodiment, the development device 40 illustrated in FIG. 4 is used. However, if a configuration in which the unevenness of toner density coincides with the unevenness of the detection sensitivity is employed, the accuracy of detection can be increased by applying the present disclosure. For example, even in the configuration as illustrated in FIG. 5, the same effect can be obtained by applying the present disclosure.

PAF and PAE do not necessarily have to correspond to the amounts of developer 100% and 0%, respectively. For example, in the case where PAF is set for the amount of developer 80% and PAE is set for the amount of developer 20%, the amount of developer in the other range may be detected by using a different method (for example, the remaining amount is calculated from the estimated amount of developer consumed along with image formation).

While the present exemplary embodiment has been described while focusing on a variation in the distance between the electrodes, the method according to the present exemplary embodiment is applicable to a part-to-part performance variation that occurs in the image forming apparatus in which the development device 40 is used. That is, by reflecting the influence of a variation of the distance between the electrodes described in the present exemplary embodiment in detection of the amount of the developer, the part-to-part performance variation in the main body of the image forming apparatus in which the development device 40 is used is also reflected. Thus, the amount of developer can be accurately detected.

In addition, while the present exemplary embodiment has been described with reference to the inter-electrode correction value used to obtain the PA' ratio, the correction technique is not limited thereto. For example, a similar effect can be obtained if the inter-electrode correction value is used for any correction related to detection of the amount of developer. For example, the developer remaining amount table may be changed by using the inter-electrode correction value. Alternatively, PAE may be varied on the basis of the magnitude of PAF, and the values of PAE and PA may be compared with each other. In this manner, it may be detected (determined) that the amount of the developer is 0% (the amount of the developer has reached the second amount of developer).

In addition, the values described herein are numerical values limited to the measurement system used by the present inventors in experiments and the like. However, in the verification of the effect of the present disclosure, any values that enable relative comparison of the changes in capacitance are satisfactory. Thus, the values used in the measurement system are used in the examples describing the effect of the present disclosure.

The present disclosure can provide a developer container unit, a development device, a process cartridge, and an image forming apparatus capable of detecting the amount of developer with high accuracy.

Second Exemplary Embodiment

A second exemplary embodiment is described below. In the following description, the same reference numerals are used to describe those elements that are identical to the elements of the first exemplary embodiment, and description of the elements are not repeated.

Figure 12:
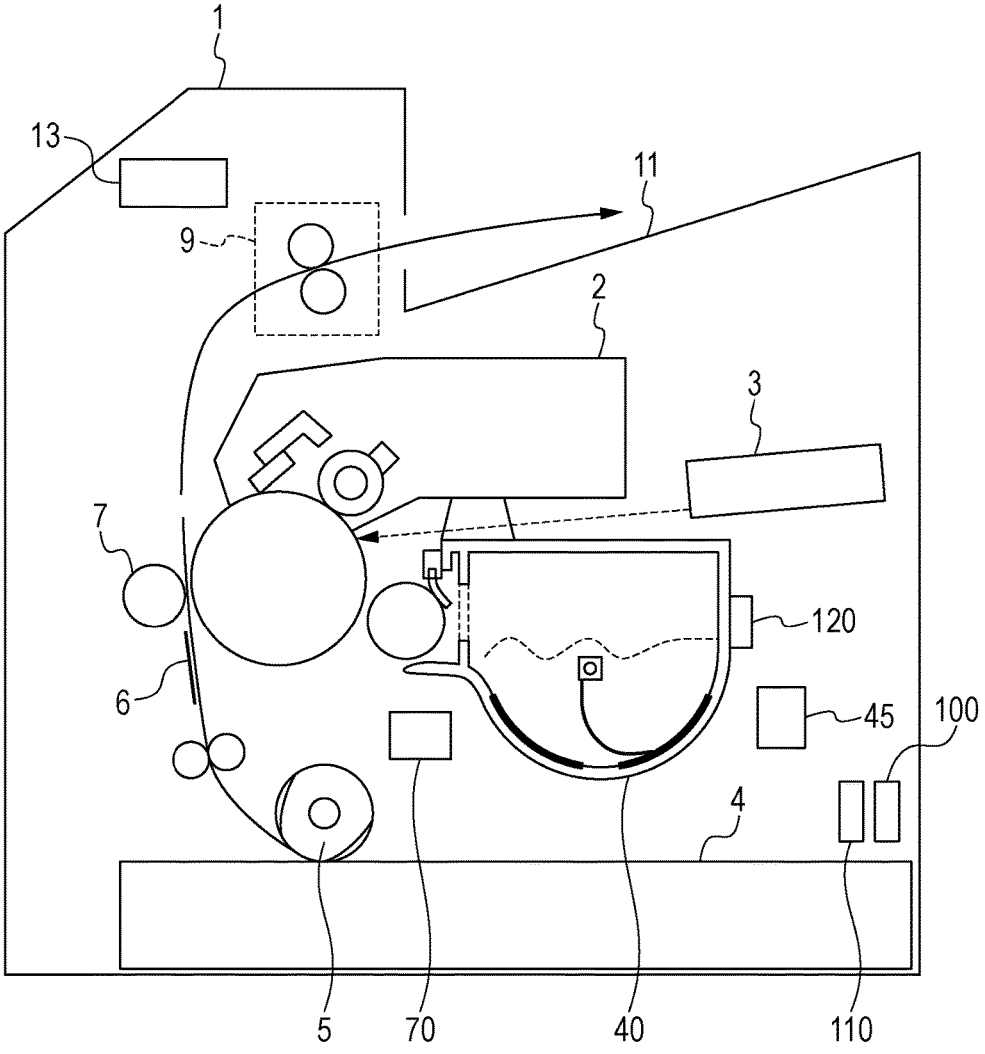
FIG. 12 is a cross-sectional view of an image forming apparatus according to one or more aspects of the present disclosure.

Overview of Configuration and Operation of Image Forming Apparatus and Process Cartridge FIG. 12 is a schematic illustration of an image forming apparatus according to the second exemplary embodiment. The image forming apparatus includes an environment detection unit 100. The environment detection unit 100 is disposed in the apparatus main body 1 of the image forming apparatus and detects the ambient temperature and humidity. The image forming apparatus corrects the bias applied to the charging roller 30 and the developing roller 41 on the basis of the result of detection. In addition, the image forming apparatus corrects control of the laser scanner unit 3, the transfer roller 7, and the fixing device 9 on the basis of the result of detection. The image forming apparatus further includes a deterioration estimation unit 110 that estimates the deterioration degree of toner from the number of revolutions of the developing roller 41.

Driving of Agitating Member and Change in Capacitance

Driving of the agitating member and a change in the capacitance according to the present exemplary embodiment are described in detail below.

Figure 13:
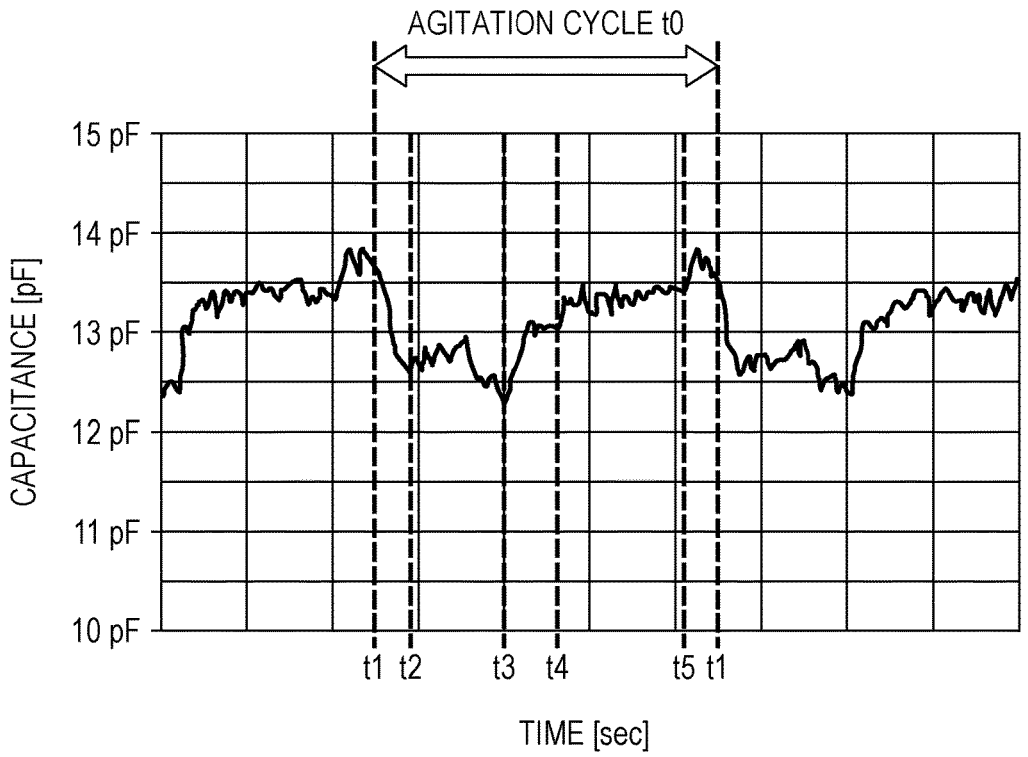
FIG. 13 illustrates a change in capacitance during a period of time in which an agitating member is driven to rotate according to one or more aspects of the present disclosure.
Figure 14:
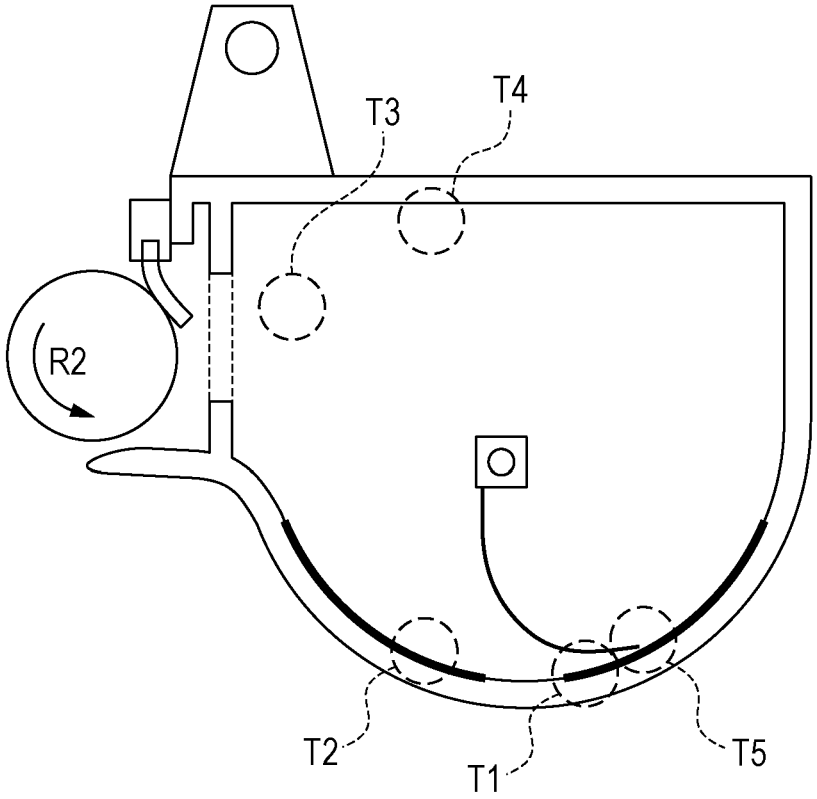
FIG. 14 is a view illustrating rotational driving of the agitating member according to one or more aspects of the present disclosure.

FIG. 13 illustrates a change in capacitance when the agitating member 60 is rotationally driven at 60 rpm when the amount of developer is 40 g according to the present exemplary embodiment. As can be seen from FIG. 13, a change in capacitance occurs at time points t1 to t5. FIG. 1.4 is a cross-sectional view of a development device according to the present exemplary embodiment. In FIG. 14, a stirring portion 60*b* passes through points T1 to T5 at some time points.

Hereinafter, by using the correspondence relationship between FIG. 13 and FIG. 14, the factors causing the change in capacitance during driving of the agitating member 60 are described.

The toner in the container (40 g) is divided into toner that is moving in the developer chamber 47 due to the rotational driving of the agitating member 60 and toner that is not moving. Herein, in order to describe a change in capacitance, only the toner that is moving is described.

First, most of the moving toner is collected in the smallest portion X1 and the surrounding vicinity when the stirring portion 60*b* passes through the point T1 in FIG. 14. As can be seen from equation (1), the capacitance has the largest value at this time point. In addition, the time point at which the capacitance in FIG. 14 has the largest value is t1. Accordingly, it can be seen that T1 in FIG. 14 corresponds to t1 in FIG. 13.

Secondly, at the time point when the stirring portion 60*b* passes through the point T2 in FIG. 14, most of the moving toner is moved away from the smallest portion X1. Accordingly, the capacitance abruptly decreases. Since the capacitance abruptly decreases at t2 in FIG. 13, it can be seen that T2 in FIG. 14 corresponds to t2 in FIG. 13.

Thirdly, most of the moving toner is lifted and moved away from the area A at the time point when the stirring portion 60*b* passes through the point T3 in FIG. 14. In addition, since the toner held on the developing roller 41 is scraped off by the stirring portion 60*b*, the capacitance has the smallest value. Since the capacitance has the smallest value at t3 in FIG. 13, it can be seen that T3 in FIG. 13 corresponds to t3 in FIG. 14.

Fourthly, at the time point when the stirring portion 60*b* passes through point T4 in FIG. 14, the toner lifted by the stirring portion 60*b* drops downward to the smallest portion X1 and the surrounding vicinity. Accordingly, the capacitance increases. Thereafter, since the stirring portion 60*b* is moving in the air without holding the toner for a while, the change in capacitance is slight. In addition, the capacitance increases at t4 in FIG. 13 and, thereafter, the change in capacitance is small until the time point t5 is reached. Therefore, it can be seen that T4 in FIG. 14 corresponds to t4 in FIG. 13.

Fifthly, at the time point when the stirring portion 60*b* passes through 15 in FIG. 14, the moving toner is collected in the smallest portion X1 and, thus, the capacitance increases. Since the capacitance increases between t5 and t1 in FIG. 13, it can be seen that T5 in FIG. 14 corresponds to t5 in FIG. 13.

Correction of Density Distribution of Developer

Correction of the density distribution of the developer, which is a feature of the present exemplary embodiment, is described below.

The developer density distribution is described first. As described above, the developer detecting unit 70 detects the amount of the toner T in the area A between the first electrode 43 and the second electrode 44. However, the density of the developer in the area A is not uniform and may vary depending on a location in the area A. Note that the density of the developer does not mean the density per toner particle, but means the weight of the developer per unit space. As used herein, such a distribution of the density of developer is referred to as "developer density distribution".

The developer density distribution varies depending on a variety of factors. For example, the developer density distribution varies when the fluidity of the toner T or the time point of falling is changed due to a change in the rotational speed of the agitating member 60 or when the fluidity and the settlement speed of the toner T are changed due to a change in the ambient temperature, ambient humidity, or deterioration degree of the developer. If the developer density distribution between the two electrodes is not uniform, the above-described change in capacitance is influenced. In particular, according to the present exemplary embodiment, the smallest portion X1 having a large contribution to the change in capacitance is provided. Accordingly, if the density of the developer in the smallest portion X1 varies, the change in the capacitance is easily influenced. Therefore, according to the present exemplary embodiment, the configuration is designed such that the influence of the developer density distribution is corrected. In this manner, the amount of developer can be detected with higher accuracy.

In addition to the basic processing method for detecting the amount of developer according to the present exemplary embodiment, this correction is described below.

The capacitance between the first electrode 43 and the second electrode 44 is influenced by, for example, a variation in the layout of the members and a product-to-product variation. Therefore, if the amount of developer is calculated directly from the absolute value of the capacitance between the first electrode 43 and the second electrode 44, there is a case in which the amount of developer is not detected with high accuracy. Accordingly, after the development device 40 is mounted in the apparatus main body 1, the developer detecting unit 70 according to the present exemplary embodiment defines the capacitance detected when the remaining amount of toner is sufficient as the first reference value. Thereafter, the developer detecting unit 70 calculates the amount of developer on the basis of the first difference from the first reference value (the magnitude of the capacitance change).

Figure 15:
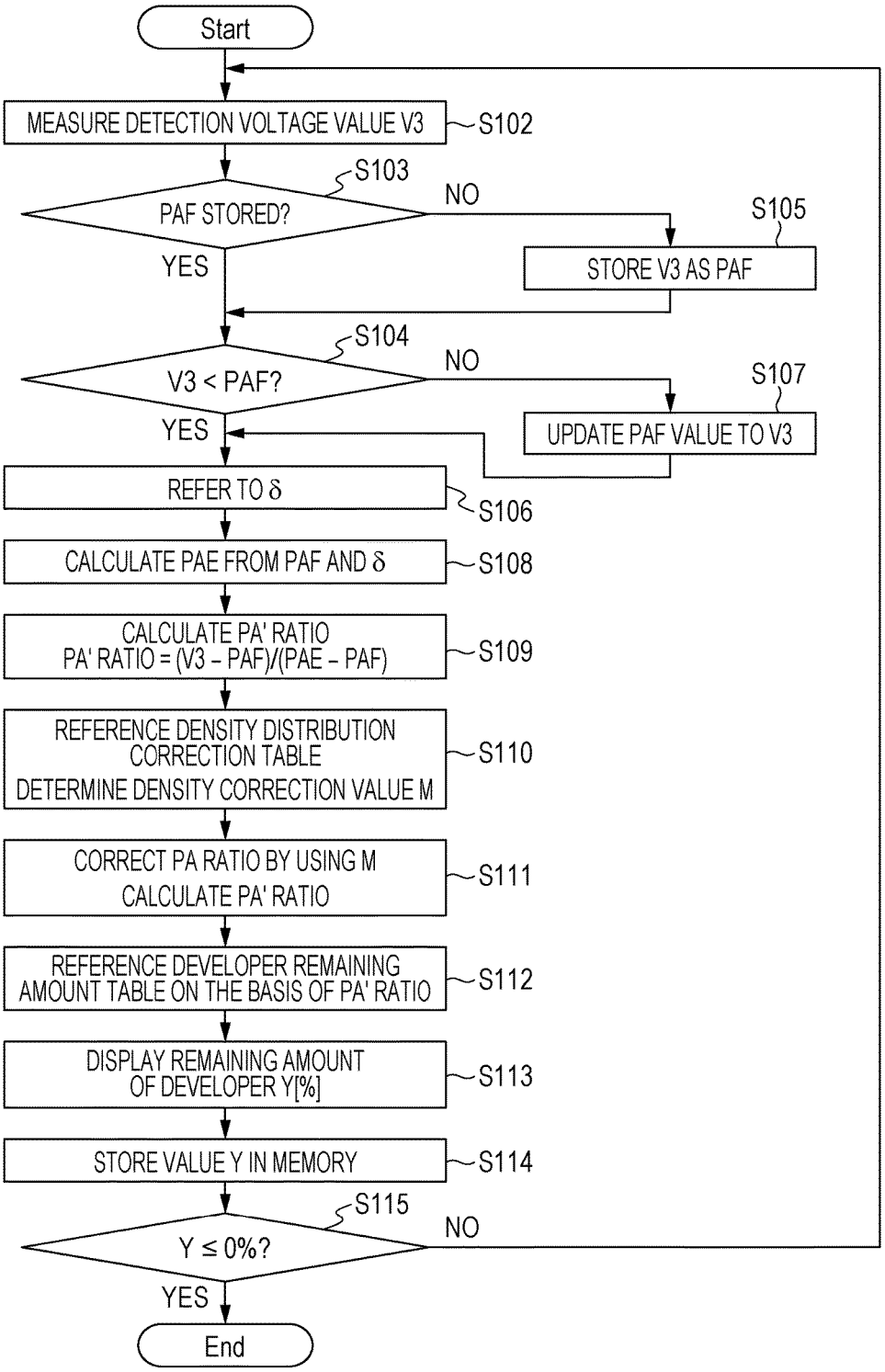
FIG. 15 illustrates the sequence of detecting the amount of developer according to one or more aspects of the present disclosure.
Figure 28:
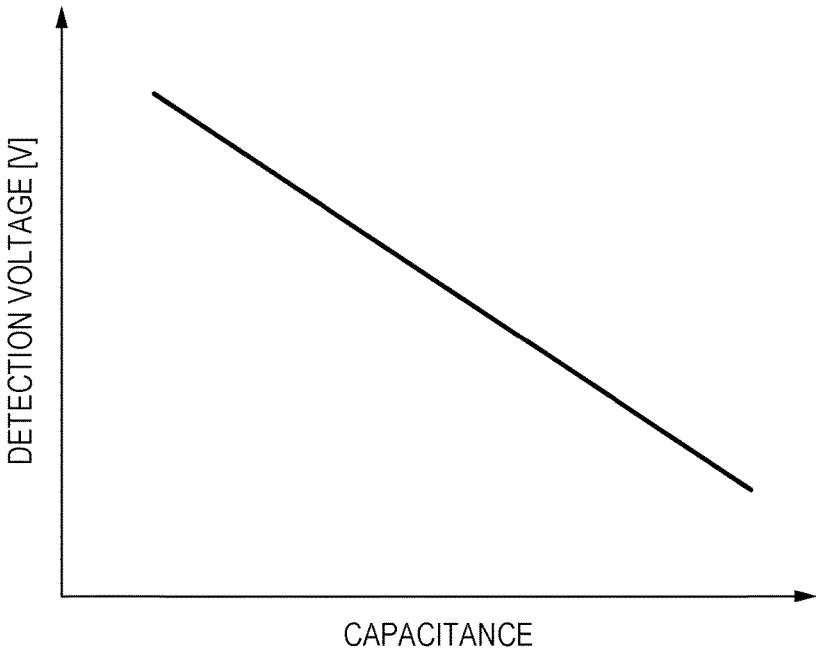
FIG. 28 illustrates the relationship between the capacitance and the detection voltage according to one or more aspects of the present disclosure.

FIG. 15 is a flowchart illustrating the sequence of detection of the amount of developer performed by the developer detecting unit 70. As described above with reference to FIG. 4, the developer detecting unit 70 measures the capacitance on the basis of the detection voltage V3. According to the present exemplary embodiment, a conversion circuit is configured so that the detection voltage decreases with increasing capacitance. That is, if the state in which the amount of toner is large is changed to a state in which the amount of toner is small, the detection voltage V3 increases. FIG. 28 is a schematic illustration of such a relationship. According to the present exemplary embodiment, the operations in the following sequence are controlled by the control unit 57. However, a separately provided control unit (not illustrated) may be employed.

(S102)

A developing bias is applied to the developing roller 41 and the second electrode 44, and the detection voltage V3, which is the average value of the detection voltage for a predetermined period of time, is measured.

(S103)

It is determined whether PAF is stored in the memory 120. If YES, the processing proceeds to S104. If NO, the processing proceeds to S105. Herein, the PAF is the detection voltage V3 (the capacitance) obtained when a sufficient amount of the toner T remains in the development device 40 (a first amount of developer). According to the present exemplary embodiment, PAF is the minimum value of the detection voltage V3. That is, PAF indicates the capacitance corresponding to the first amount of developer (the amount of developer when the remaining amount of toner is sufficient, for example, when the amount of developer is 100%). According to the present exemplary embodiment, PAF is not stored at the time of shipment of the process cartridge. However, a tentative value may be stored at the time of shipment.

(S105)

If, in S103, PAF is not stored, the detection voltage V3 detected at this time is stored as PAF.

(S104)

It is determined whether the detection voltage V3 is lower than the PAF currently stored. If YES, the processing proceeds to S106. If NO, the processing proceeds to S107.

Herein, as the amount of toner decreases, the detection voltage V3 increases. Accordingly, if the amount of toner decreases, the processing proceeds to S106. In addition, for example, the toner may be collected in one part of the development device 40, but the toner may be stabilized after the development device 40 is continuously used. In this case, the detection voltage V3 detected immediately after the start of use increases. However, after the toner is stabilized, the detection voltage V3 decreases. Accordingly, the processing proceeds to S107.

(S107)

If, in S104, the detection voltage V3 is lower than the PAF currently stored, the PAF is updated to the detection voltage V3 at this point. Therefore, when the above-described unevenness of distribution of the toner is eliminated, the detection voltage V3 in a stable state can be defined as PAF.

(S106)

In order to calculate the second amount of developer smaller than the first amount of developer, the difference δ (the first difference) of a detection voltage V3, which occurs when the amount of toner decreases from the first amount of developer to the second amount of developer, is referenced. According to the present exemplary embodiment, the difference δ is a fixed value stored in the memory 120. According to the present exemplary embodiment, the difference δ is determined so that the detection voltage (PAE described below) indicating the second amount of developer is set to the detection voltage V3 detected when the process cartridge reaches the end of its service life.

(S108)

By using the detection voltage (the capacitance) PAF, which indicates the first amount of developer, as a reference value, a detection voltage (a capacitance) having the difference δ from PAF is referred to as "PAE". PAE indicates the magnitude of a detection voltage (a capacitance) corresponding to a second amount of developer (a second reference value). In this case, a voltage obtained by adding the difference δ to PAF is calculated as PAE. As described above, PAE is an estimated value of the detection voltage V3 when the process cartridge reaches the end of its service life (for example, when the amount of developer is 0%).

(S109)

In order to calculate a third amount of developer which is smaller than the first amount of developer (for example, an amount of developer of 100%) and larger than the second amount of developer (for example, an amount of developer of 0%), the following processing is performed.

By using PAF as a reference value, a difference (second difference) between the current detection voltage V3 and PAF is obtained. Thereafter, a ratio of the second difference to the first difference (the difference δ) (the PA ratio) is calculated. That is, the following equation (2) is calculated:

$$PA\ \text{ratio}=(V3-PAF)/(PAE-PAF) \quad (2).$$

That is, since the detection voltage V3 is closer to PAF as the toner decreases, the PA ratio increases. Conversely, as the amount of toner increases, the PA ratio decreases.

(S110)

A correction value M for correcting the influence of the density distribution of the developer is referenced and determined. According to the present exemplary embodiment, the correction value M is a correction value used to perform correction on the basis of at least one of the rotational speed of the agitating member 60, the ambient temperature, the ambient humidity, and the deterioration degree of the developer.

As described above, the density distribution of the developer is influenced by the rotational speed of the agitating member 60, the ambient temperature, the ambient humidity, and the deterioration degree of the developer. Due to this influence, the detection voltage V3 deviates from the original value. Therefore, there is a possibility that the above-described PA ratio is offset from the original one. In order to correct for the influence of these factors, a correction is made in consideration of the tendency of the influence of each of the rotational speed of the agitating member 60, the ambient temperature, the ambient humidity, and the deterioration degree of the developer on the detection voltage V3. That is, for example, a correction is made in consideration of the tendency indicating which one of high rotational speed and low rotational speed increases or decreases the detection voltage V3. The correction value M (the developer density distribution correction value) for correcting for the influence of the density distribution of the developer is determined in consideration of such a tendency. That is, if there is an influence (an influential factor) that increases the detected voltage (the detected capacitance) or the PA ratio to a value larger than the original value, a correct is made so that the detected voltage (the detected capacitance) or the PA ratio is decreased. However, if there is an influence (an influential factor) that decreases the detected voltage (the capacitance) or the PA ratio to a value smaller than the original one, a correction is made so that the detected voltage (the detected capacitance) or the PA ratio is increased.

A correction for the influence of factors, such as the rotational speed of the agitating member 60, the ambient temperature, the ambient humidity, and the degree of deterioration of the developer, is described in detail below.

(S111)

A correction is made so as to vary the PA ratio by using the correction value M. According to the present exemplary embodiment, the PA ratio is multiplied by the correction value M so as to obtain the PA' ratio, which is a corrected PA ratio. Depending on the type of density correction value M, a correction may be made by adding the correction value M to the PA ratio or subtracting the correction value M from the PA ratio.

(S112)

Figure 16:
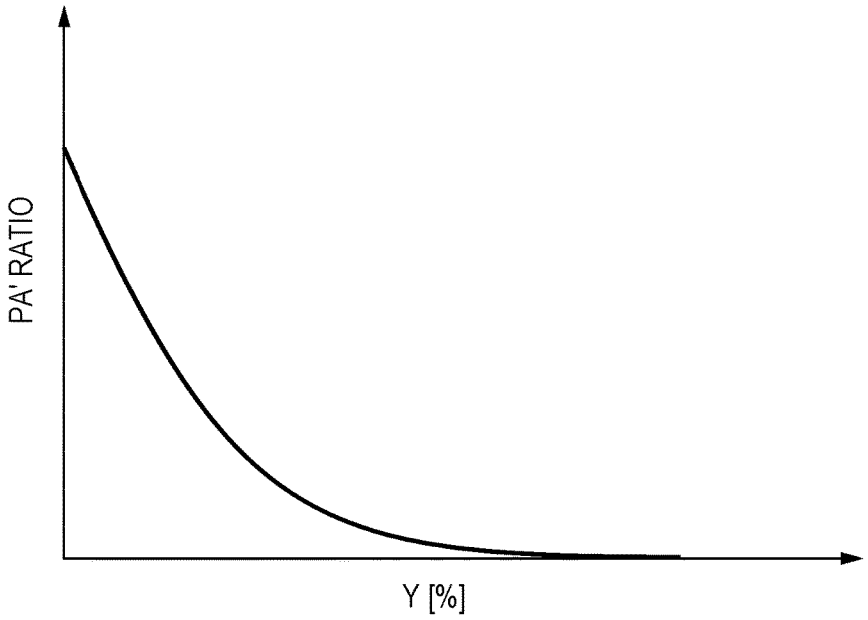
FIG. 16 illustrates an example of a toner remaining amount table according to one or more aspects of the present disclosure.

The toner remaining amount table is referenced. The toner remaining amount table denotes the relationship between the PA ratio (in this case, the corrected PA' ratio) and the amount of developer in the development device 40. According to the present exemplary embodiment, the toner remaining amount table is stored in the memory 120. An example of the toner remaining amount table is illustrated in FIG. 16. The ordinate represents the PA' ratio, and the abscissa represents the amount of developer.

(S113)

The amount of developer Y [%] is obtained by comparing the PA' ratio with the toner remaining amount table. Thereafter, the value Y [%] is displayed on the display unit 13.

(S114)

The value Y [%] is stored in the memory 120.

(S115)

Steps S102 to S114 are repeated until the value Y reaches 0%. When the value Y reaches 0%, detection of the amount of developer is stopped.

According to the above-described sequence, by correcting the developer density distribution, the amount of developer can be detected more accurately.

Note that PAF and PAE do not necessarily have to correspond to the amounts of developer 100% and 0%, respectively. For example, in the case where PAF is set to a value corresponding to the amount of developer 80% and PAE is set to a value corresponding to the amount of developer 20%, the amount of developer in the other range may be detected by using a different method (for example, the remaining amount is calculated from the estimated amount of developer consumed along with image formation).

Correction of Developer Density Distribution by Rotational Speed of Agitating Member A correction related to the rotational speed of the agitating member is described below. According to the present exemplary embodiment, the main body of the image forming apparatus has such an image forming mode that the image forming apparatus operates at different process speeds in accordance with the image forming conditions, and the rotational speed of the agitating member 60 varies in accordance with the process speed. That is, the agitating member 60 can rotate at a plurality of rotational speeds.

Note that the developer density distribution may vary in accordance with the rotational speed of the stirring portion 60*b*. That is, in light of the relative relationship between falling due to own weight of the toner and the agitation speed, when, for example, the rotational speed of the agitating member is low, the density tends to increase in the lower portion as compared with the case of high speed. In addition, in the configuration according to the present exemplary embodiment, since the contribution of the lower side of the electrode pair to a change in capacitance is made higher than the upper side of the electrode pair, the configuration may be influenced by the developer density distribution. Therefore, according to the developer density distribution correction control, which is a feature of the present exemplary embodiment, the amount of developer can be detected more accurately by correcting detection of the amount of developer in accordance with the developer density distribution varying in accordance with the rotational speed of the agitating member.

In the configuration according to the present exemplary embodiment, the rotational speed of the agitating member varies in accordance with the image forming mode having different process speeds. However, the configuration is not limited thereto. The same effect can be provided by performing similar control in the case where the rotational speed of the agitating member 60 varies. According to the present exemplary embodiment, two image forming modes are provided, and the agitating member is driven to rotate at a rotational speed of 60 rpm or 30 rpm (a half speed mode).

Driving of the agitating member and the capacitance according to the present exemplary embodiment is described in detail first. Driving of the agitating member and the capacitance has been described with reference to the example illustrated FIGS. 13 and 14, in which the agitating member 60 is driven to rotate at a rotational speed of 60 rpm. Hereinafter, a phenomenon that occurs when the rotational speed of the agitating member 60 is 30 rpm is described.

First, the agitation cycle is doubled, as compared with the case of driving at 60 rpm. However, in this regard, by, for example, extending the measurement duration (the sampling interval) for obtaining the average of capacitance values to double the duration, the output corresponding to the revolutions of the same agitating member 60 can be obtained.

A change in capacitance corresponding to each of the zones illustrated in FIG. 14 that occurs in the case of a rotational speed of 30 rpm is described with reference to FIG. 13.

In a zone from the points T1 to T3 in FIG. 14, the capacitance values remain unchanged, in general.

In a zone from the points T3 to T4 in FIG. 14, the toner lifted by the stirring portion 60*b* falls. At this time, the period of time from t3 to t4 is twice the time period required in the case of a rotational speed of 60 rpm, whereas the falling speed of the toner remains unchanged. Therefore, as compared with the case of a rotational speed of 60 rpm, the stirring portion 60*b* drops the toner toward the smallest portion X1 at a position closer to T3 in FIG. 14. Therefore, in the graph of FIG. 13, the toner appears to behave as if falling earlier. Thus, during a period of time from t3 to t4 in the case of a rotational speed of 30 rpm, a change in capacitance occurs so that the capacitance increases at a time point closer to t3 than in the case of a rotational speed of 60 rpm.

In addition, in a zone from the points T4 to T5 in FIG. 14, the stirring portion 60*b* is moving in the air. However, even in this zone, the capacitance slightly changes (increases). In this zone, the dropped toner is being settled. At this time, while the period of time from t4 to t5 is doubled, the speed at which the toner is settled remain unchanged. Therefore, the toner is settled in the smallest portion X1 and the surrounding vicinity when the stirring portion 60*b* is positioned closer to T4 in FIG. 14 than in the case of a rotational speed of 60 rpm. Thus, the density increases. As a result, in the graph illustrated in FIG. 13, the toner appears to behave as if being settled earlier, and the capacitance increases, although only slightly.

In a zone from points T5 to T1 in FIG. 14, the toner moving while the stirring portion 60*b* is moving is collected in the smallest portion X1. Therefore, there is no influence of the rotational speed of the agitating member 60. However, since there is influence of the toner being settled in the zone from T4 to T5, the capacitance increases, although only slightly.

As described above, when the rotational speed of the agitating member is changed from 60 rpm to 30 rpm, the average density of the developer (the toner) tends to be higher in the lower portion and, thus, the output indicating a capacitance that tends to increase is obtained. Accordingly, by performing the developer density distribution correction, which is a feature of the present exemplary embodiment, the amount of developer can be detected with high accuracy.

Figure 17:
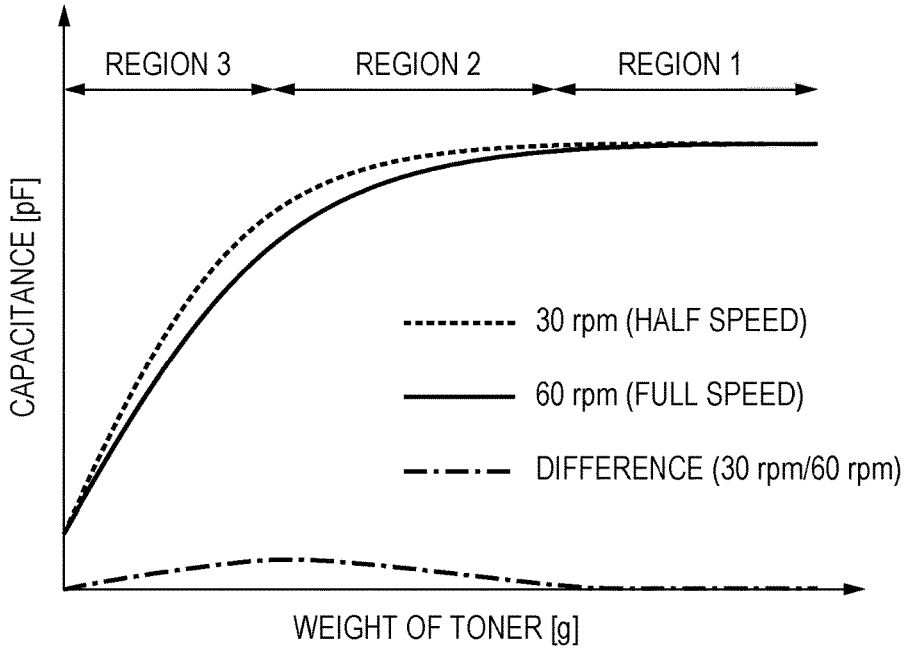
FIG. 17 illustrates the relationship between the rotational speed of the agitating member and the capacitance value according to one or more aspects of the present disclosure.

FIG. 17 illustrates the amounts of developer and the capacitance changes when the agitating member 60 is driven to rotate at 60 rpm and when the agitating member 60 is driven to rotate at 30 rpm. As described above, since the developer density distributions differ from each other, the capacitance values differ from each other. The difference between the capacitance values in the cases of rotational speeds of 60 rpm and 30 rpm is illustrated in FIG. 17. As can be seen from FIG. 17, the difference varies in accordance with the amount of developer. This is because, for example, when the amount of developer is sufficiently large, the influence of the speed of the agitating member 60 is reduced since the amount of developer in the area A is saturated. In the saturated state, a state in which a change caused by the influence of the speed of the agitating member 60 does not occur even when the weight of the toner decreases continues for a while. Such a state is indicated as a "region 1" in FIG. 17. Subsequently, after the saturated state ends, a change caused by the speed of the agitating member 60 gradually occurs. Such a state is indicated as a "region 2" in FIG. 17. Subsequently, when the weight of the toner further decreases, the change caused by the speed of the agitating member 60 decreases. Such a state is indicated as a "region 3" in FIG. 17. This is because when the weight of the toner is, for example, 0 g, the change caused by the speed of the agitating member 60 disappears since the developer density distribution itself disappears.

In addition, the difference between the capacitance in the case of a rotational speed of the agitating member of 60 rpm and the capacitance in the case of a rotational speed of 30 rpm at this time is illustrated in FIG. 17. The difference represents the needed correction amount. Therefore, in the developer density distribution correction according to the present exemplary embodiment, the change amount (a correction value M1) is changed in accordance with the amount of developer. That is, when the amount of developer is large, the correction amount is small. The correction amount is increased as the amount of developer decreases. Thereafter, the correction amount is decreased as the amount of developer is closer to zero. Control is performed in this manner. That is, the correction value used in this correction is a correction value that increases with decreasing amount of developer of the development device 40 and, thereafter, decreases with further decreasing amount of developer in the development device 40 after the correction value increases. Note that the correction value is stored in the memory 120 and is referenced in accordance with the rotational speed.

The correction actually performed is described with reference to FIG. 15.

In (S110), a correction value M1 (a density distribution correction value) corresponding to the rotational speed of the agitating member 60 is determined by referencing a table that is stored in the memory 120 and that denotes the relationship between the PA ratio and the density distribution correction value. As described above, the necessary correction values are different depending on the amount of developer in the development device 40. Therefore, according to the present exemplary embodiment, a table in which the correction value M1 varies in accordance with the PA ratio (the amount of developer in the development device 40) is used. Subsequently, in (S111), a PA' ratio is calculated by multiplying the PA ratio by the obtained correction value M1. The other processes performed are the same as those illustrated in FIG. 15.

According to the above-described sequence, by performing the developer density distribution correction, the difference in development density distribution caused by the difference in speed of the agitating member can be corrected. As a result, the amount of developer can be detected more accurately.

While the present exemplary embodiment has been described with reference to the PA ratio corrected by using the density distribution correction value M1 obtained from the density distribution correction value table, another method may be employed. For example, a density distribution correction formula may be selected in advance, and the correction value M1 may be calculated by using the density distribution correction formula. Alternatively, the toner remaining amount table, the value of the detection voltage V3, or the value Y representing the result of detection may be corrected by using the density distribution correction value or the density distribution correction formula. Still alternatively, for further simplification, by performing the developer density distribution correction for only the vicinity of Y=0%, the amount of toner in the region where the amount of developer is small can be accurately detected. For example, by correcting the toner remaining amount table, the value of the detection voltage V3, or the value Y representing the result of detection on the basis of the density distribution correction value optimized for the vicinity of Y=0%, the amount of developer can be accurately detected. Still alternatively, by directly correcting the δ value described in S106 on the basis of the density distribution correction value optimized for the vicinity of Y=0%, the amount of developer can be accurately detected.

Third Exemplary Embodiment

The third exemplary embodiment is described below with reference to the following example. That is, the process cartridge 2 is removably mounted in the main body of each of a plurality of types of image forming apparatuses having different rotational speeds of the agitating member 60 (having driving units for rotating the agitating member 60 at different speeds). According to the present exemplary embodiment, the same type of process cartridge can be inserted into the main body of each of two types of image forming apparatuses, that is, an image forming apparatus main body model A and an image forming apparatus main body model B which operate at different process speeds. According to the present exemplary embodiment, since the process speeds are different, the photoconductive drum 20 rotates at a speed of 200 mm/s in the model A, whereas the photoconductive drum 20 rotates at a speed of 100 mm/s in the model A. Accordingly, the agitating member 60 rotates at 60 rpm in the model A, and the agitating member 60 rotates at 30 rpm in the model B.

Note that while the present exemplary embodiment is described with reference to a configuration that enables a process cartridge to be inserted into two models having different process speeds, the configuration is not limited thereto. Any configuration that drives the agitating member 60 at different speeds by using at least a drive transmission unit of the image forming apparatus main body that drives the agitating member 60 at different transmission speeds can be employed. For example, a configuration that enables the model A and the model B to have the same process speed and different rotational speeds of only the agitating members 60 can be employed.

Note that the density distribution correction value is the same as the correction value M1 described in the second exemplary embodiment, which varies with the rotational speed of the agitating member 60.

The actual correction is described with reference to FIG. 15.

In (S110), a table denoting the relationship between the PA ratio and the density distribution correction value, which is stored in the memory 120, is referenced, and a correction value M2 (a density distribution correction value) corresponding to the model of the image forming apparatus (the rotational speed of the agitating member 60) is determined. Subsequently, in (S111), the PA' ratio is calculated by multiplying the PA ratio by the obtained correction value M2. The other processes performed are the same as those illustrated in FIG. 15.

According to the above-described sequence, by correcting the developer density distribution, the difference in the development density distribution depending on the speed of the agitating member can be corrected and, thus, the amount of developer can be detected more accurately.

Fourth Exemplary Embodiment

The fourth exemplary embodiment is described below with reference to the following example that increases the accuracy of detection. That is, a change in the toner density distribution caused by the flowability which changes depending on the temperature and the humidity at the time of use is corrected on the basis of the detection result of an environment detection unit.

As illustrated in FIG. 12, the apparatus main body 1 has an environment detection unit 100. The environment detection unit 100 is a sensor disposed in the apparatus main body 1. The environment detection unit 100 detects at least one the ambient temperature and humidity.

As described in the second exemplary embodiment, the density of the toner in the smallest portion X1 and the surrounding vicinity is related to the settlement speed of the toner after the toner is stirred in the area A and the falling speed of the toner after the toner is lifted by the agitating member and, thereafter, falls into the area A. If the settlement speed is high, the amount of developer in the smallest portion X1 and the surrounding vicinity increases (the density of the developer increases) during a period of time from t4 to t1. Accordingly, the capacitance increases. In addition, in the case where a large amount of toner remains and, thus, the agitating member 60 cannot transport all of the toner, some toner remains in the area A even after the agitating member 60 has passed through the area A. Accordingly, the capacitance increases in a period of time between t2 and t3. If the falling speed is high, the amount of developer that can be detected at the time point t4 in FIG. 13 increases and, thus, the capacitance at the time point t4 increases.

If, for example, the toner is heavy and the angle of repose is low, the falling speed increases. The weight of toner increases if the toner contains a large amount of a magnetic material and, thus, the density is high or the particle size of the toner is large. In terms of the angle of repose, the flowability of toner increases if, for example, the external additive has a large particle size, the amount of the external additive is large, the external additive has a high sphericity, or the electrostatic influence or the influence of water crosslinking is high. In addition, the flowability decreases if the surface property of the agitating member 60, which is related to the work function indicating the degree of absorption of the agitating member 60, is rough and the contact area is small. The settlement speed increases if, for example, the toner is heavy and the amount of air contained in the toner is small. The amount of air contained in the toner decreases if, for example, the above-described flowability of the toner is low.

Among the above-described factors, by correcting the factors which vary depending on the use conditions of the user, the accuracy of detecting the amount of developer can be increased more. According to the present exemplary embodiment, the accuracy of detection is increased by correcting a change in the toner density distribution caused by the flowability, which changes depending on the temperature and humidity at the time of use, on the basis of the result of detection of the environment detection unit.

Figure 18:
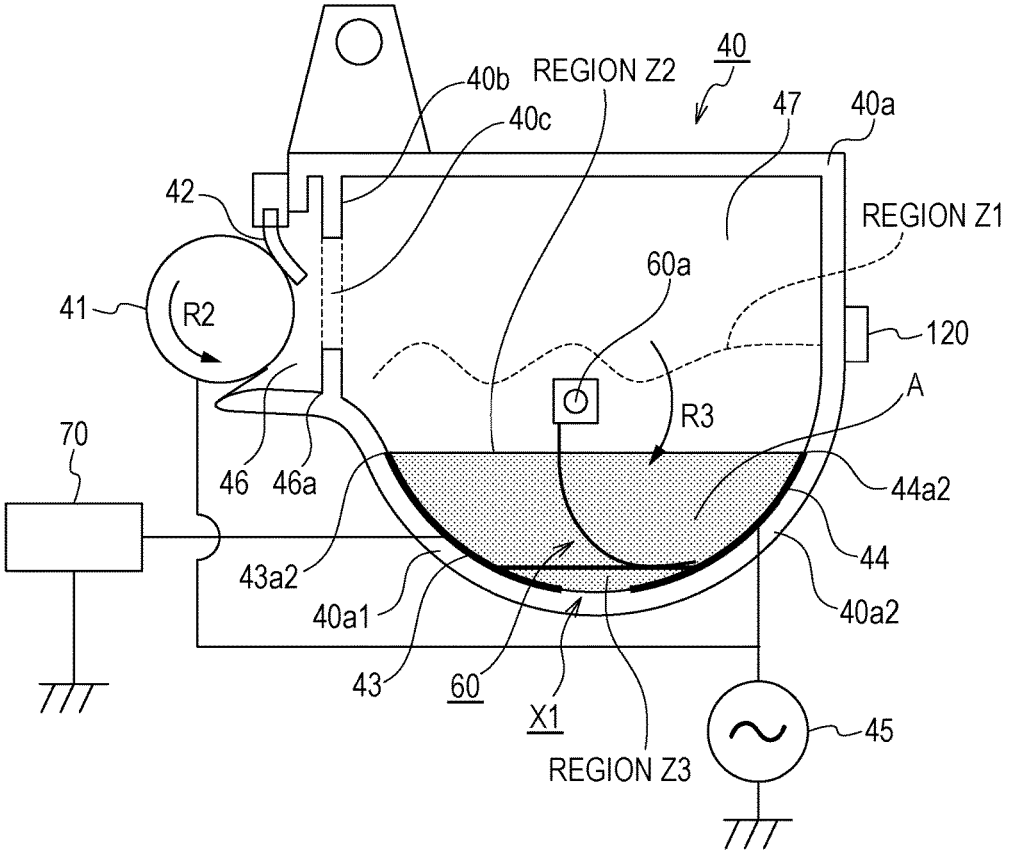
FIG. 18 illustrates the height of developer accumulated in the development device according to one or more aspects of the present disclosure.

FIG. 18 is a schematic illustration of a region Z1, a region Z2, and a region Z3 relating to the amount of developer in the development device 40. The regions Z1, Z2, and Z3 are used in the following description. The dotted line represents the toner agent surface in the region Z1, the solid line represents the toner agent surface in the region Z2, and the thick line represents the toner agent surface in the region Z3.

Figure 19:
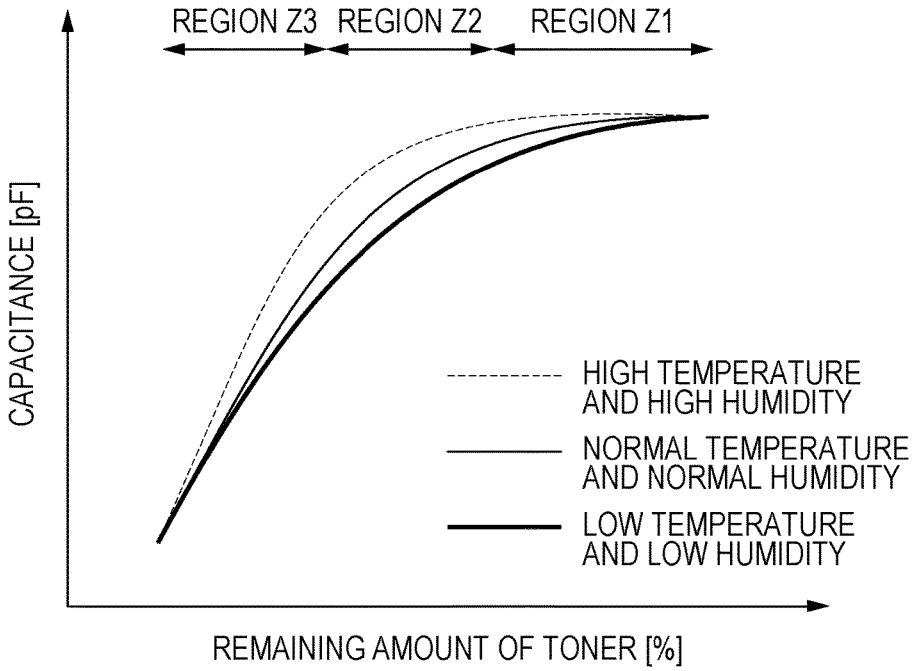
FIG. 19 illustrates the relationship between the amount of developer and the average of the capacitance values when the use environment changes according to one or more aspects of the present disclosure.

FIG. 19 illustrates the capacitance changing with the amount of developer. The solid line indicates the relationship in a normal temperature and normal humidity environment, the broken line indicates the relationship in a high temperature and high humidity environment, and the thick line indicates the relationship in a low temperature and low humidity environment. According to the present exemplary embodiment, the room temperature and humidity is 23° C./50% Rh, the high temperature and high humidity is 30° C./80% Rh, and the low temperature and low humidity is 15° C./10% Rh. The reason why the capacitance value with respect to the amount of developer is different in each environment is that the fluidity of the toner varies depending on the environment. For example, when water crosslinking reaction progresses under high temperature and high humidity, the toner density becomes relatively high even when the toner is being stirred. Therefore, the settlement speed also becomes relatively high. In particular, the settlement speed becomes remarkably high in a region where the toner is present in the smallest portion X1 and the surrounding vicinity at all times (that is, in the region Z2). In contrast, in a low temperature and low humidity environment, the influence of water crosslinking decreases, so that air contained in the toner increases by stirring and, thus, the fluidity increases. Since the amount of contained air increases, the settlement speed decreases. In particular, the density of toner in the smallest portion X1 and the surrounding vicinity remarkably and relatively decreases in the region Z2. As described above, since the density of the toner in the smallest portion X1 and the surrounding vicinity in which the detection sensitivity is high changes, the capacitance fluctuates.

In addition, in each of the environments, the magnitude relationship of a change in capacitance caused the environment is as follows: region Z2>>region Z1>region Z3. In the region Z1 in which the amount of the developer is large, even when the agitating member 60 passes through the area A, the toner enters the space formed after the agitating member 60 has passed and, thus, the density distribution of the toner in the smallest portion X1 and the surrounding vicinity negligibly changes. Therefore, even when the fluidity of the toner changes due to an environmental change, the magnitude of the capacitance change is small. In the region Z3 in which the amount of developer is small, even when the density is reduced due to air contained in the toner, the magnitude of the capacitance change is small, since almost all of the toner is located inside of the smallest portion X1 and the surrounding vicinity where the detection sensitivity is high. Accordingly, the capacitance negligibly changes even if the environment changes and, thus, the flowability of the toner changes. In the region Z2 between the regions Z1 and Z3, immediately after the agitating member 60 passes through the area A, air enters the toner and, thus, the density of the toner in the smallest portion X1 and the surrounding vicinity largely varies. Therefore, when the settlement speed varies depending on the environment, the capacitance fluctuates most remarkably. Note that according to the present exemplary embodiment, the environmental difference is the largest when the amount of developer is 30%.

According to the present exemplary embodiment, since pulverized toner having a small amount of external additive is used, the hydrophilicity of the toner is relatively high. Thus, the fluidity is decreased in a high temperature and high humidity environment, as described above. In contrast, if the amount of the external additive is increased to increase the hydrophobicity, the flowability in a high temperature and high humidity environment increases. However, the triboeletricity increases in a low temperature and low humidity environment and, thus, electrostatic aggregation occurs, which decreases the fluidity. In the case of such toner, since the relationship between the broken line and the thick line in FIG. 19 is reversed, the correction direction described below is also reversed.

According to the present exemplary embodiment, in the region Z1, 100%≥the amount of developer>40%. In the region Z2, 40%≥the amount of developer>10%. In the region Z3, 10%≥the amount of developer≥0%. Note that these relationships may change depending on the shape of the developer container and the location and shape of the electrode pair.

Figure 20:
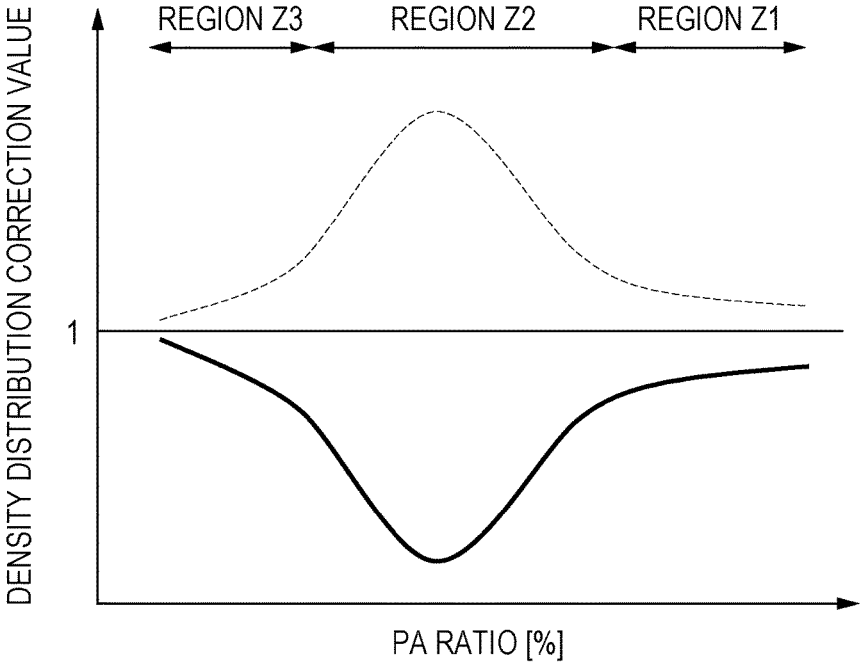
FIG. 20 illustrates the relationship between a PA ratio and a density distribution correction value according to one or more aspects of the present disclosure.

The correction value M3 used in the present exemplary embodiment is obtained by referencing the density distribution correction value table on the basis of the PA ratio and the detection result from the environment detection unit 100 (the result of determination of the environment being used on the basis of the temperature and humidity). The density distribution correction value table is illustrated in FIG. 20. The ordinate represents the correction value M3, and the abscissa represents the PA ratio. The broken line indicates the value in a high temperature and high humidity environment, and the thick line indicates the value in a low temperature and low humidity environment. According to the present exemplary embodiment, when the water vapor amount ≤5 g/m$^3$, a correction is made by using the broken line in the density distribution correction value table. When 15 g/m$^3$≤ the water vapor amount, a correction is made by using the thick line in the density distribution correction value table. To increase the accuracy, the number of the levels of the amount of water vapor can be increased. However, since the capacity of the table increases, the load imposed on the memory 120 increases. According to the present exemplary embodiment, to efficiently increase the detection accuracy, two levels are set.

Note that the correction value M3 used in the correction is also a correction value that increases with decreasing amount of developer in the development device 40. If the amount of developer in the development device 40 further decreases after the correction value has increased, the correction value M3 decreases.

The actual correction is described with reference to FIG. 15.

In (S110), the correction value M3 (the density distribution correction value) corresponding to the use environment is determined by referencing the above-described table that is stored in the memory 120 and that denotes the relationship between the PA ratio and the density distribution correction value. Subsequently, in (S111), a PA' ratio is calculated by multiplying the PA ratio by the obtained correction value M3. The other processes performed are the same as those illustrated in FIG. 15.

Other Techniques for Increasing Accuracy of Developer Amount Detection

Figure 21:
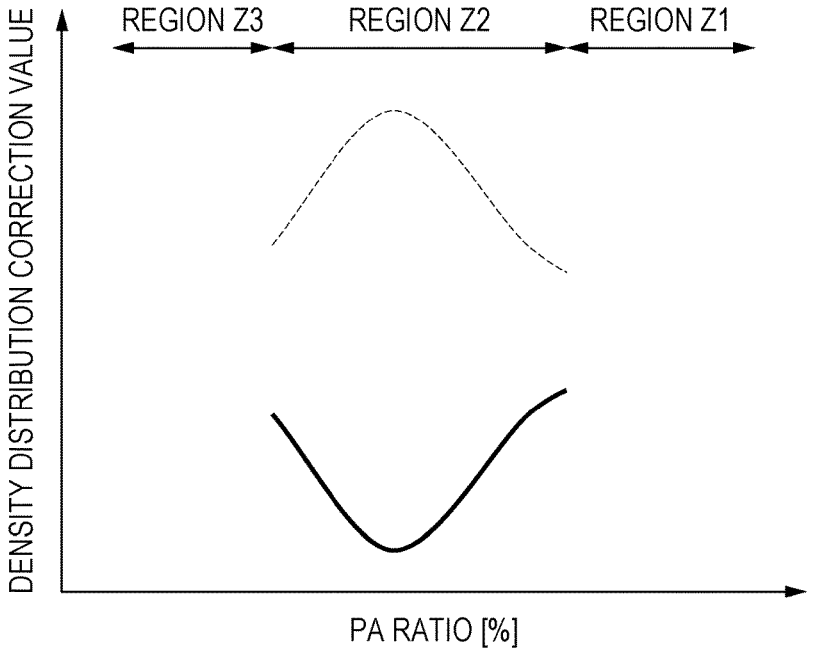
FIG. 21 illustrates a density distribution correction value for which the PA ratio to be corrected is limited according to one or more aspects of the present disclosure.

The density distribution correction value table is different depending on each of PA ratios, each of temperature/humidity values, and the location of each of the second electrodes 44 (described below). Ideally, all of the tables are stored in the memory 120. However, it is sometimes difficult to store all of the tables due to the limit of the capacity of the memory 120. In this case, for example, only the value for the region Z2 in which the fluctuation is the largest may be corrected, so that accuracy improvement can be expected with less capacity. More specifically, a reference table illustrated in FIG. 21 is used. Note that if a PA ratio outside the correction range is obtained, the density distribution correction value is set to 1.

In addition, according to the present exemplary embodiment, the environment detection unit 100 detects both temperature and humidity. However, in view of the limits of the space and cost, a sensor that detects only a temperature may be used. In this case, for example, a resistance value can be detected by applying a bias to the charging roller 30 or the transfer roller 7 and detecting the amount of current. Thereafter, the humidity can be calculated from the resistance value, and correction can be performed. In addition, even when only one of the temperature and humidity can be detected, the tables as illustrated in FIGS. 20 and 21 can be generated on the basis of detectable information, and a correction can be made.

Figure 22:
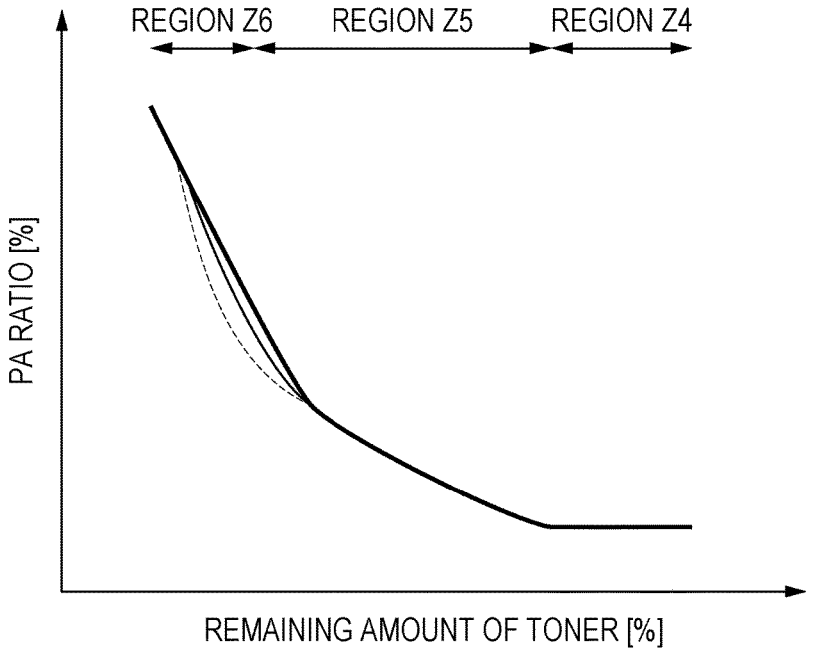
FIG. 22 illustrates the relationship between the amount of developer in a large capacity cartridge and the PA ratio according to one or more aspects of the present disclosure.

In addition, in the case of a large-capacity process cartridge 2 illustrated in FIG. 5, a change in the PA ratio corresponding to the amount of developer varies among the environments. The changes are illustrated in FIG. 22. The environments indicated by the solid line, the broken line, and the thick line are the same as those illustrated in FIG. 19. A region Z4 is a region in which toner is present in the areas A and B and in which a change in PA ratio is small with respect to the amount of developer. A region Z5 is a region in which a change in the PA ratio for the amount of developer slightly appears since the amount of toner in the area B decreases. However, since the region Z5 is spaced apart from the developing roller 41, the change in PA ratio is small. A region Z6 is a region in which the toner in the area B disappears and the toner in area A is about to decrease. Since the region Z6 is close to the developing roller 41, the amount of change in the PA ratio is the largest. Since as described above, the environmental change is greatly influenced by the density distribution of the toner in the area A, a change that occurs in the region Z6 increases. Since the amount of change in the PA ratio with respect to the amount of developer due to the environment varies, a different density distribution correction value table needs to be used.

For example, the memory 120 is disposed in each of the process cartridges, and the memory 120 stores a remaining toner detection table and a density distribution correction value table each of which is different depending on the toner filling amount, the arrangement, the number, and the shape of the second electrodes 44. In this manner, even when the process cartridges 2 with different toner filling amounts are mounted, the user can be notified of the amount of developer with high accuracy.

Configuration of Comparative Example 1

The configuration of comparative example 1 does not include a density distribution correction value table and, thus, the capacitance value varies in accordance with the environment.

Figure 23:
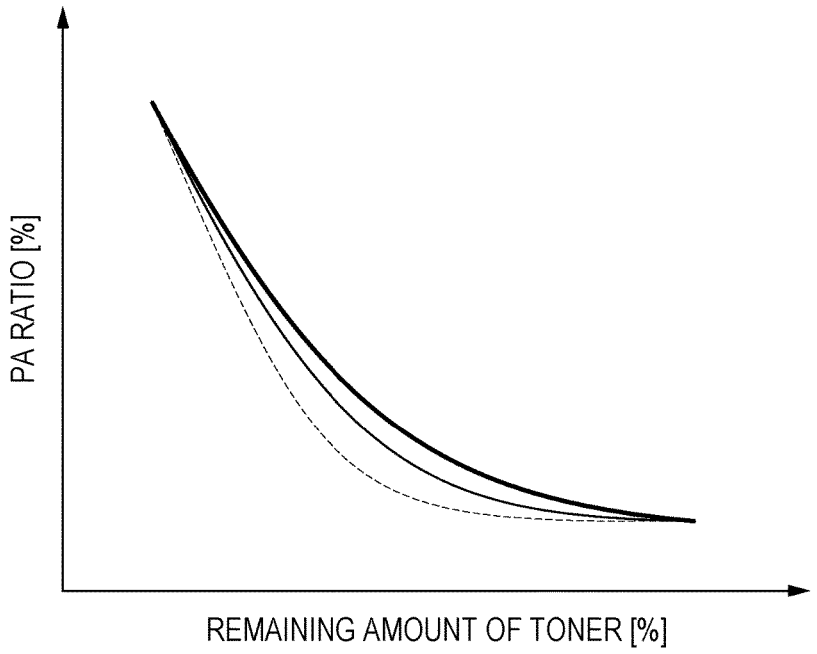
FIG. 23 illustrates the relationship between the amount of developers and the PA ratio according to one or more aspects of the present disclosure and Comparative Example 1.

Comparison of Configurations of Embodiment and Comparative Example 1 in Terms of Remaining Amount Detection Accuracy FIG. 23 illustrates the PA ratio changing with the amount of developer. The abscissa represents the amount of developer, and the ordinate represents the PA ratio. The solid line indicates the PA ratio (with correction) in the configuration according to the present exemplary embodiment and in comparative example 1 (without correction) at normal temperature and normal humidity. The thick line indicates a change in the PA ratio in comparative example 1 at low temperature and low humidity. The broken line illustrates a change in the PA ratio in comparative example 1 at high temperature and high humidity. According to the configuration of comparative example 1, an amount of developer that differs from the actual amount of developer is reported depending on the environment. In contrast, according to the configuration of the fourth exemplary embodiment, an accurate amount of developer is reported in all of the environments.

Fifth Exemplary Embodiment

According to the fifth exemplary embodiment, the following example is described. That is, the detecting unit used when the density distribution correction is performed in the second exemplary embodiment is the deterioration estimation unit 110 instead of the environment detection unit 100.

Main Body Configuration

As illustrated in FIG. 12, the apparatus main body 1 includes the deterioration estimation unit 110. The deterioration estimation unit 110 according to the present exemplary embodiment estimates the deterioration degree of the toner from the number of revolutions of the developing roller 41.

Figure 24:
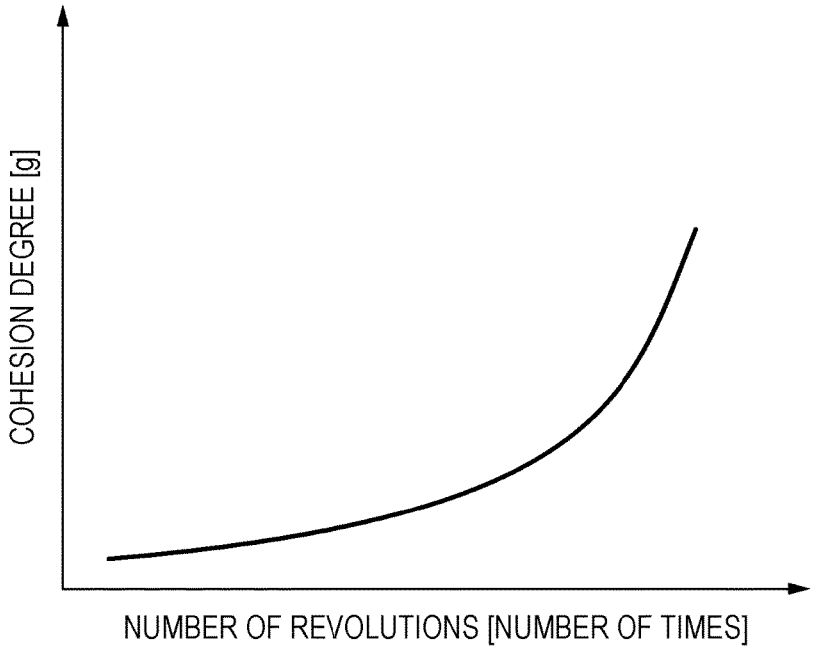
FIG. 24 illustrates the relationship between the number of revolutions of a developing roller and the cohesion degree of the toner according to one or more aspects of the present disclosure.

Relationship Between Degradation Estimation and Detection of Amount of Developer FIG. 24 illustrates the relationship between the number of revolutions of the developing roller 41 and the fluidity of the toner. The abscissa represents the number of revolutions of the developing roller 41, and the ordinate represents the cohesion degree of the toner. The cohesion degree of the toner is obtained by placing 2 g of the toner in the vicinity of the developing roller 41 on a mesh with an aperture of 100 μm, vibrating the mesh with an amplitude of 2 mm at 50 Hz, and measuring the weight of the toner remaining on the mesh. It can be seen from FIG. 24 that the cohesion degree increases with increasing number of revolutions of the developing roller 41. The reason for this is as follows: The number of times the toner is regulated by the developing blade 42 increases with increasing number of revolutions. When regulated by the developing blade 42, the toner is rubbed at a high pressure, so that the external additive is peeled off or embedded in the mother body. Thus, deterioration of the toner is accelerated. If the toner deteriorates in this way, the fluidity of the toner decreases. As the fluidity decreases, the amount of developer delivered to the vicinity of the developing blade 42 decreases and, thus, the amount of toner on the surface of the developing roller 41 decreases. If the amount of toner decreases, the pressure exerted on one particle of toner in a regulating portion of the developing blade 42 increases, so that deterioration is further promoted. Therefore, the cohesion degree, that is, the degree of deterioration can be estimated by using the number of revolutions of the developing roller 41 from FIG. 24.

Figure 25:
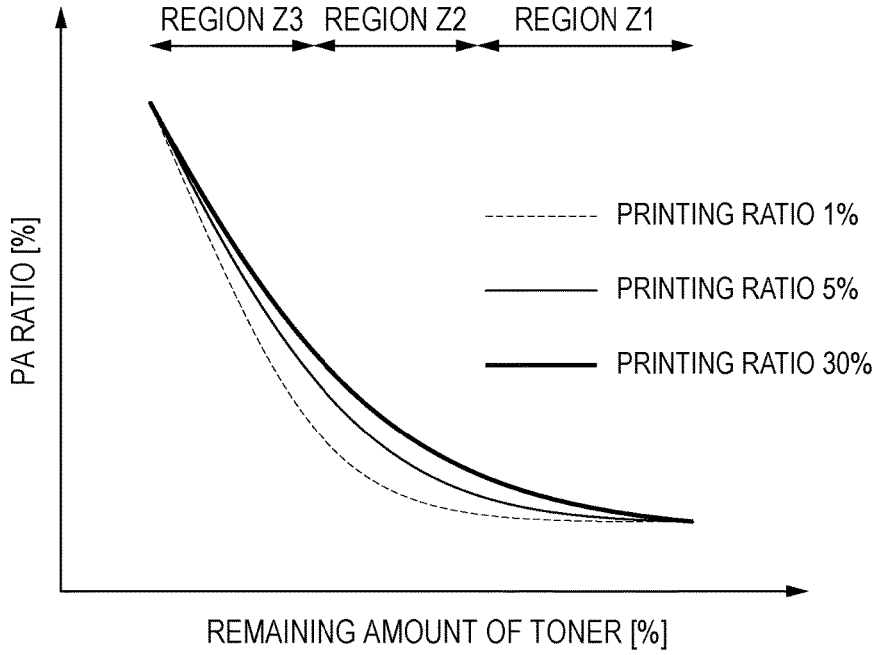
FIG. 25 illustrates the relationship between the amount of developer and the PA ratio when the printing ratio is changed according to one or more aspects of the present disclosure.

In the configuration according to the present exemplary embodiment, if the fluidity of the toner changes, the result of detection performed by the developer detecting unit 70 is offset as described above. FIG. 25 illustrates the relationship between the amount of developer and the PA ratio when the printing ratio is changed. The abscissa represents the amount of developer, and the ordinate represents the PA ratio. The solid line indicates the relationship when the printing ratio is 5%. The broken line indicates the relationship when the printing ratio is 1%, and the thick line indicates the relationship when the printing ratio is 30%. Regions Z1 to Z3 are the same as those of the fourth exemplary embodiment. As the printing ratio decreases, the PA ratio with respect to the amount of developer decreases. This is because, even for the same amount of developer, the number of times the toner passes through the regulating portion increases and the toner is consumed in a state where deterioration of the toner is promoted, so that the fluidity of the toner decreases and, thus, the toner density in the smallest portion X1 and the surrounding vicinity increases. Similarly, the reason why the influence in the region Z2 is large is that the fluidity of the toner is changed and the same phenomenon as in, for example, the second exemplary embodiment occurs.

Figure 26:
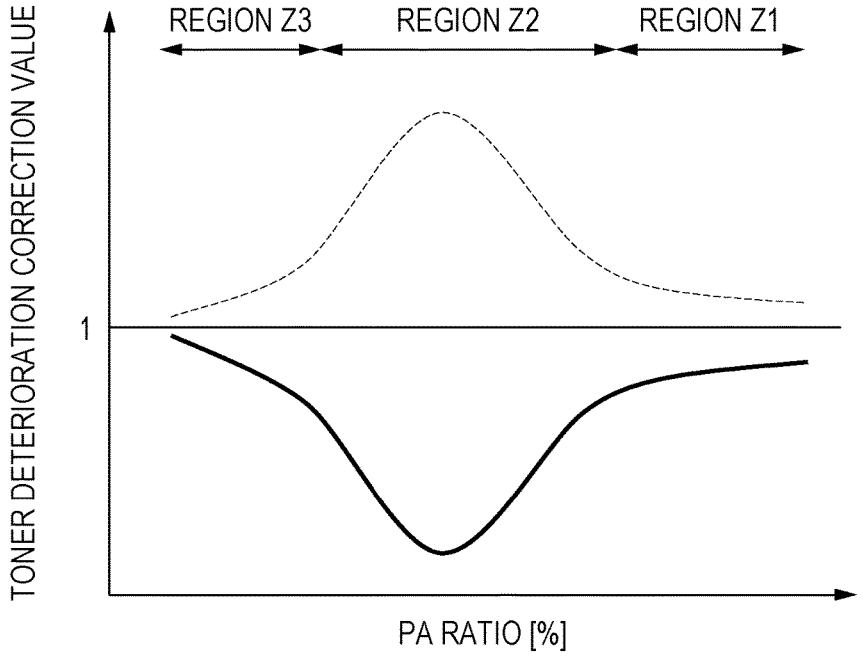
FIG. 26 illustrates the relationship between the PA ratio and a toner deterioration correction value according to one or more aspects of the present disclosure.

A correction value M4 used in the present exemplary embodiment is a density distribution correction value (a toner deterioration correction value) of the developer. The correction value M4 is used for correction relating to the deterioration degree of the developer and is obtained by referencing a toner deterioration correction value table stored in the memory 120 on the basis of the number of revolutions of the developing roller 41 detected by the deterioration estimation unit 110. FIG. 26 illustrates the toner deterioration correction value table. The abscissa represents the PA ratio, and the ordinate represents a toner deterioration correction value R. The broken line indicates a toner deterioration correction value table when the number of revolutions of the developing roller 41 is small. According to the present exemplary embodiment, the toner deterioration correction value table indicated by the broken line is used for correction in the case where the number of revolutions <192000. The bold line indicates a toner deterioration correction value table when the number of revolutions of the developing roller 41 is large, which is used for correction in the case where the number of revolutions ≥296000.

To increase the detection accuracy, the number of levels of the number-of-revolution threshold can be increased. However, since the capacity of the table increases, the load imposed on the memory 120 increases. Accordingly, to efficiently increase the detection accuracy, two levels are set.

Like the above-described correction values, the correction value M4 used in this correction is a correction value that increases with decreasing amount of developer in the development device 40. If the amount of developer in the development device 40 further decreases after the correction value M4 increases, the correction value M4 decreases.

The actual correction is described with reference to FIG. 15.

In (S110), the correction value M4 corresponding to the number of revolutions of the developing roller 41 is determined by referencing a table that is stored in the memory 120 and that denotes the relationship between the PA ratio and the density distribution correction value. Subsequently, in (S111), a PA' ratio is calculated by multiplying the PA ratio by the obtained correction value M4, The other processes performed are the same as those illustrated in FIG. 15.

Other Techniques for Increasing Accuracy of Developer Amount Detection

According to the present exemplary embodiment, the number of revolutions of the developing roller 41 is counted by a toner deterioration degree estimation unit. Alternatively, the cumulative exposure time of the scanner unit 3 can be used. This is because if the cumulative exposure time is short, the printing ratio is low and, thus, the number of times the toner is rubbed by the developing blade 42 increases, even when the same amount of developer is consumed. Thus, deterioration is promoted. In addition, if the most recent cumulative exposure time is taken into account, the accuracy of estimation of toner deterioration can be expected to increase. The toner on the developing roller 41 in the case where the most recent cumulative exposure time is short is less frequently replaced than the toner on the developing roller 41 in the case where the cumulative exposure time is long, so that the number of times the toner is rubbed in the regulating portion increases. Accordingly, deterioration of the toner is promoted. When the toner returns to the area A, the fluidity of the toner in the area A is low until the toner is consumed. Thus, the capacitance value increases. Accordingly, when the most recent cumulative exposure time is short, the toner deterioration correction value is set so that the capacitance value decreases. In contrast, when the most recent cumulative exposure time is long, the toner deterioration correction value is set so that the capacitance value increases. In this manner, the estimation accuracy of toner deterioration increases. As a result, the accuracy of remaining amount detection can be increased.

In addition, by estimating the deterioration by using both the number of revolutions of the developing roller 41 and the cumulative exposure time of the scanner unit 30, the accuracy of detection of the remaining amount can be increased more. This is because if the number of revolutions of the developing roller 41 increases, the toner transportability of the developing roller 41 decreases and, thus, the amount of developer per unit area of the developing roller 41 decreases. Since the amount of developer passing through the regulating portion decreases, the pressure applied to one toner particle increases, so that deterioration of toner is relatively promoted regardless of the cumulative exposure time.

When the process cartridges 2 having different container shapes are mounted, the memory 120 that stores a toner deterioration correction value table optimum for the shape may be disposed in each of the process cartridges 2. In this manner, the accuracy of detection of the remaining amount of toner can be increased.

In addition, if the variation in accordance with toner deterioration in the regions Z1 and Z3 is small, the values in the toner deterioration correction value table corresponding to the regions Z1 and Z3 may be removed from the memory 120 to reduce the load imposed on the capacity of the memory 120. In such a case, by setting all of the correction values M4 for the regions Z1 and Z3 to 1, the accuracy of detection of the remaining amount can be efficiently increased.

Configuration of Comparative Example 2

The configuration of the comparative example 2 does not include the toner deterioration correction value table. Accordingly, the PA value varies depending on the deterioration degree of the toner.

Figure 27:
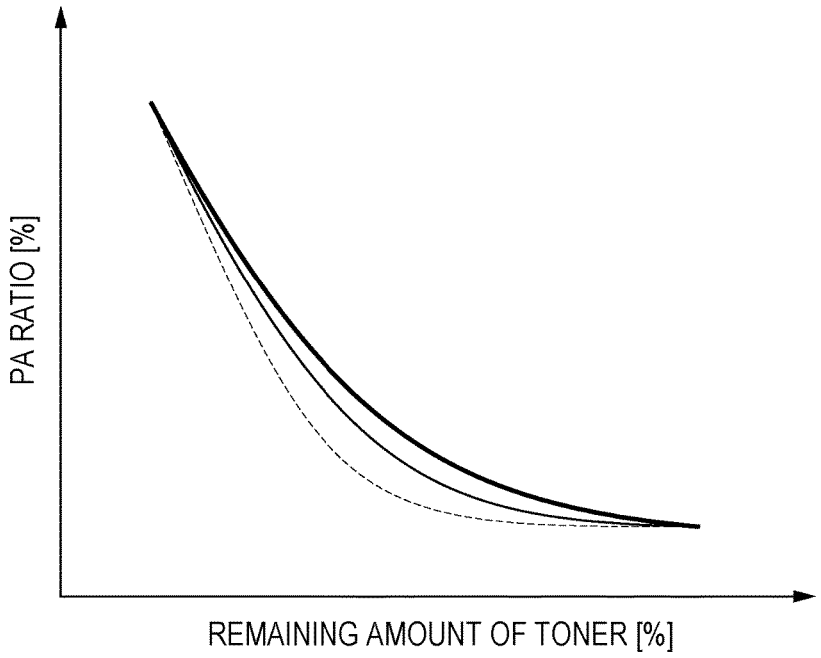
FIG. 27 illustrates the relationship between the amount of developer and the PA ratio according to one or more aspects of the present disclosure and comparative example 2.

Comparison of Configurations of Embodiment and Comparative Example 2 in Terms of Remaining Amount Detection Accuracy FIG. 27 illustrates the PA ratio changing with the amount of developer. The abscissa represents the amount of developer, and the ordinate represents the PA ratio. The solid line indicates the relationship in the present exemplary embodiment and comparative example 2 when the printing ratio is 5%. The thick line indicates the relationship in comparative example 2 when the printing ratio is 30%, and the broken line indicates the relationship in comparative example 2 when the printing ratio is 1%. According to the configuration of comparative example 2, an amount of developer that differs from the actual amount of developer is reported depending on the deterioration degree of the toner. In contrast, according to the configuration of the fifth exemplary embodiment, an accurate amount of developer is reported regardless of the deterioration degree of the toner.

As can be seen from the second to fifth exemplary embodiments described above, by correcting the developer density distribution, the amount of developer can be detected more accurately. While the above exemplary embodiments have been described with reference to correction in accordance with the speed of the agitating member 60, the ambient temperature, the ambient humidity, and the deterioration degree of developer, correction in accordance with a plurality of factors may be performed at the same time as needed. In such a case, the amount of developer can be detected more accurately than in the case where a correction in accordance with a single factor is made.

In addition, the main body 1 of the image forming apparatus may enable a plurality of types of the development devices 40 to be removably mounted therein. The plurality of types of the development devices 40 have at least one of different arrangement or shape of the first electrode 43 and the second electrode 44, the number of the electrode pairs, and the amount or type of developer filled in the frame body 40*a*. In this case, it is desirable that the above-described correction values be different values optimum for the arrangement or shape of the first electrode 43 and the second electrode 44, the number of the electrode pairs, or the amount or type of developer filled in the frame body 40*a*. By storing such correction values in the memories 120, the accuracy of detection of the amount of toner can be increased more.

Note that the correction described in the first exemplary embodiment and the correction described in the second to fifth embodiments can be combined in any way as needed. That is, the difference δ between PAF and PAE may be varied in accordance with the magnitude of the PAF. Thereafter, the PA' ratio described in the first exemplary embodiment may be calculated. The correction described in the second to fifth embodiments may be performed on the PA' ratio calculated in this manner to detect the amount of developer.

According to the present disclosure, an image forming apparatus capable of increasing the accuracy of detection of the amount of developer can be provided.

While the present disclosure has been described with reference to exemplary embodiments, the scope of the following claims are to be accorded the broadest interpretation so as to encompass all such modifications and equivalent structures and functions.

This application claims the benefit of Japanese Patent Application No. 2016-132602 filed Jul. 4, 2016, No. 2016-132603 filed Jul. 4, 2016, and No. 2017-107460 filed May 31, 2017, which are hereby incorporated by reference herein in their entirety.

What is claimed is:

1. An image forming apparatus comprising:

a developer container unit including an agitating member configured to rotate and agitate developer, a frame body configured to contain the agitating member and the developer, the frame body including a first wall surface and a second wall surface, a first electrode disposed on the first wall surface, the first electrode including a first end, the first end located below a rotation center of the agitating member, and a second electrode disposed on the second wall surface, the second electrode including a second end located below the rotation center, the second electrode facing the first electrode with a gap therebetween such that the gap has a smallest portion and a remote portion, wherein the smallest portion is located below the rotation center of the agitating member and located between the first end and the second end, and the remote portion is wider than the smallest portion and located above the smallest portion; and a developer detecting unit configured to detect an amount of the developer based on an output generated in accordance with a capacitance between the first electrode and the second electrode, the developer detecting unit capable of detecting a first amount of developer and a second amount of developer that is smaller than the first amount of developer, wherein if a magnitude of the output when the developer detecting unit detects the first amount of developer is defined as a first reference value, the developer detecting unit is configured to detect the second amount of developer when a magnitude of the output is a second reference value which has a first difference from the first reference value, and wherein the developer detecting unit includes a controller and is configured to determine a magnitude of the first difference based on a magnitude of the first reference value such that the second reference value and the magnitude of the first difference are varied in accordance with the magnitude of the first reference value.

2. The image forming apparatus according to claim 1, wherein the developer detecting unit is capable of detecting a third amount of developer that is smaller than the first amount of developer and larger than the second amount of developer, and wherein when a difference between a magnitude of the output corresponding to the third amount of developer and the first reference value is defined as a second difference, the developer detecting unit is configured to detect the third amount of developer on the basis of a ratio of the second difference to the first difference.

3. The image forming apparatus according to claim 1, wherein the first difference when the first reference value is large is larger than when the first reference value is small.

4. The image forming apparatus according to claim 1, wherein the first difference when a difference between a predetermined value and the first reference value is large is larger than when the difference between the predetermined value and the first reference value is small.

5. The image forming apparatus according to claim 1, wherein the first reference value is set when the agitating member is operated for a predetermined period of time or the agitating member rotates a predetermined number of turns.

6. The image forming apparatus according to claim 1, further comprising:

an AC power source configured to apply an AC voltage to one of the first electrode and the second electrode, wherein the output is a voltage generated in the other of the first electrode and the second electrode by the AC voltage.

7. The image forming apparatus according to claim 1, wherein the first wall surface extends upward with respect to a gravity direction and extends away from the smallest portion with respect to a horizontal direction, and the second wall surface extends upward with respect to the gravity direction and extends away from the smallest portion with respect to the horizontal direction.

8. The image forming apparatus according to claim 7, wherein each of the first wall surface and the second the second is a curved surface, and wherein the first electrode is disposed along the first wall surface so as to be in contact with the first wall surface, and the second electrode is disposed along the second wall surface so as to be in contact with the second wall surface.

9. The image forming apparatus according to claim 7, wherein the developer container unit includes a developer bearing member configured to develop an electrostatic latent image formed on an image bearing member.

10. The image forming apparatus according to claim 9, wherein the frame body includes a developing chamber containing the developer bearing member, a developer chamber containing the agitating member, and a partition wall having an opening that allows the developing chamber to communicate with the developer chamber, and wherein the first wall surface and the second wall surface are disposed in the developer chamber.

11. The image forming apparatus according to claim 10, wherein the smallest portion is located below the developing chamber.

12. The image forming apparatus according to claim 9, wherein the developer detecting unit is configured to detect the amount of developer based on an output in accordance with a combined capacitance of the capacitance and a capacitance between the first electrode and the developer bearing member.

13. The image forming apparatus according to claim 1, wherein the agitating member rotates so as to pass through the smallest portion.

14. The image forming apparatus according to claim 1, wherein the first electrode and the second electrode are formed of a conductive resin and are formed as sheet members integrated into the frame body.

15. An image forming apparatus comprising:

a developer container unit including a developer bearing member configured to develop an electrostatic latent image formed on an image bearing member, an agitating member configured to rotate and agitate developer, a frame body including a developing chamber containing the developer bearing member, a developer chamber containing the agitating member, a partition wall provided with an opening that allows the developing chamber to communicate with the developer chamber, a first wall surface disposed in the developer chamber, and a second wall surface disposed in the developer chamber, a first electrode disposed on the first wall surface, the first electrode including a first end, the first end located below a rotation center of the agitating member, and a second electrode disposed on the second wall surface, the second electrode including a second end located below the rotation center, the second electrode facing the first electrode with a gap therebetween such that the gap has a smallest portion and a remote portion, wherein the smallest portion is located below the rotation center of the agitating member and located between the first end and the second end, and the remote portion is wider than the smallest portion and located above the smallest portion; and a developer detecting unit configured to detect an amount of the developer based on an output generated in accordance with a capacitance between the first electrode and the second electrode, wherein the first wall surface extends upward with respect to a gravity direction and extends away from the smallest portion with respect to a horizontal direction, and the second wall surface extends upward with respect to the gravity direction and extends away from the smallest portion with respect to the horizontal direction, and wherein the developer detecting unit includes a controller and is configured to correct the output on the basis of at least one of a rotational speed of the agitating member, an ambient temperature, an ambient humidity, and a deterioration degree of the developer and detects the amount of developer.

16. The image forming apparatus according to claim 15, wherein the developer detecting unit is capable of detecting a first amount of developer, a second amount of developer that is smaller than the first amount of developer, and a third amount of developer that is smaller than the first amount of developer and larger than the second amount of developer, and wherein if a magnitude of the output when the developer detecting unit detects the first amount of developer is defined as a first reference value, a magnitude of the output when the developer detecting unit detects the second amount of developer is defined as a second reference value, and a difference between the first reference value and the second reference value is defined as a first difference, and a difference between a magnitude of the output corresponding to the third amount of developer and the first reference value is defined as a second difference, the developer detecting unit is configured to detect the third amount of developer on the basis of a ratio of the second difference to the first difference.

17. The image forming apparatus according to claim 16, wherein the correction is performed by varying the ratio.

18. The image forming apparatus according to claim 15, further comprising:

an AC power source configured to apply an AC voltage to one of the first electrode and the second electrode, wherein the output is a voltage generated in the other of the first electrode and the second electrode by the AC voltage.

19. The image forming apparatus according to claim 15, wherein each of the first wall surface and the second wall surface is a curved surface, and wherein the first electrode is disposed along the first wall surface so as to be in contact with the first wall surface, and the second electrode is disposed along the second wall surface so as to be in contact with the second wall surface.

20. The image forming apparatus according to claim 15, wherein the smallest portion is located below the developing chamber.

21. The image forming apparatus according to claim 15, wherein the developer detecting unit is configured to detect the amount of developer based on an output generated in accordance with a combined capacitance of the capacitance and a capacitance between the first electrode and the developer bearing member.

22. The image forming apparatus according to claim 15, wherein the correction includes correction based on a deterioration degree of the developer, and wherein the image forming apparatus further comprises a deterioration estimation unit configured to estimate the deterioration degree of the developer.

23. The image forming apparatus according to claim 22, further comprising:

an exposure device configured to expose an image bearing member and form an electrostatic latent image, wherein the deterioration estimation unit estimates the deterioration degree of the developer on the basis of at least one of the number of revolutions of the developer bearing member and an exposure time of the exposure device.

24. The image forming apparatus according to claim 15, wherein the agitating member rotates so as to pass through the smallest portion.

25. The image forming apparatus according to claim 15, wherein the first electrode and the second electrode are formed of a conductive resin and are formed as sheet members integrated into the frame body.

26. The image forming apparatus according to claim 15, wherein the correction includes correction based on the rotational speed, and the agitating member is rotatable at a plurality of rotational speeds.

27. The image forming apparatus according to claim 15, wherein the correction includes correction based on one of the ambient temperature and the ambient humidity, and wherein the image forming apparatus further comprises an environment detection unit configured to detect at least one of temperature and humidity.

28. The image forming apparatus according to claim 15, further comprising:

a storage unit configured to store a correction value used for the correction.

29. The image forming apparatus according to claim 28, wherein the correction value is variable in accordance with the amount of developer.

30. The image forming apparatus according to claim 28, wherein a plurality of types of the developer container units having at least one of different arrangement or shape of the first electrode and the second electrode, the number of the pairs comprising the first electrode and the second electrode, and the amount of developer contained in the frame body are removably mountable, and wherein the correction value varies depending on one of the arrangement or shape of the first electrode and the second electrode, the number of the pairs consisting of the first electrode and the second electrode, and the amount of developer contained in the frame body.

* * * * *